US009074370B2

(12) United States Patent
Long, Sr.

(10) Patent No.: US 9,074,370 B2
(45) **Date of Patent: *Jul. 7, 2015**

(54) LOAD TRANSFER DEVICE

(71) Applicant: Composite Technologies Corporation, Boone, IA (US)

(72) Inventor: Robert T. Long, Sr., Ames, IA (US)

(73) Assignee: Composite Technologies Corporation, Boone, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/291,651

(22) Filed: May 30, 2014

(65) Prior Publication Data

US 2014/0298743 A1 Oct. 9, 2014

Related U.S. Application Data

(63) Continuation of application No. 13/468,167, filed on May 10, 2012, now Pat. No. 8,839,580.

(60) Provisional application No. 61/484,966, filed on May 11, 2011.

(51) Int. Cl.

| | |
|---|---|
| ***E04C 2/288*** | (2006.01) |
| ***E04C 2/04*** | (2006.01) |
| ***E04C 2/52*** | (2006.01) |
| *E04C 2/34* | (2006.01) |

(52) U.S. Cl.

CPC ..... *E04C 2/288* (2013.01); *E04C 2/044* (2013.01); *E04C 2/526* (2013.01); *E04C 2002/046* (2013.01); *E04C 2/34* (2013.01)

(58) Field of Classification Search

None

See application file for complete search history.

(56) References Cited

U.S. PATENT DOCUMENTS

| | | | | |
|---|---|---|---|---|
| 4,624,089 | A * | 11/1986 | Dunker | 52/410 |
| 4,669,240 | A * | 6/1987 | Amormino | 52/236.6 |
| 5,222,338 | A * | 6/1993 | Hull et al. | 52/405.3 |
| 5,758,461 | A * | 6/1998 | McManus | 52/293.3 |
| 6,088,985 | A | 7/2000 | Clark | |
| 7,393,577 | B2 * | 7/2008 | Day et al. | 428/121 |
| 8,833,020 | B2 * | 9/2014 | Oliver et al. | 52/292 |

OTHER PUBLICATIONS

Extended European Search Report for European Patent Application No. 12275067.2 dated Jul. 16, 2014.

* cited by examiner

*Primary Examiner* — Charles A Fox
*Assistant Examiner* — Joseph J Sadlon
(74) *Attorney, Agent, or Firm* — Brick Gentry PC; Brian J. Laurenzo; Jessica L. Susie

(57) ABSTRACT

A load transfer device is provided to connect concrete elements including, but not limited to, sandwich and double wall panel wythes, roof, floor, balcony and canopy members, and pavement. The device may be used to connect and transfer loads between the components of sandwich and double wall panels. The device includes two load transfer members positioned at an angle with respect to one another. Additionally provided are a retention housing for retaining one or more load transfer members at their angled positions and a depth locating means for retaining one or more load transfer members at their proper depth. Also provided are sandwich wall panels and double wall panels employing the load transfer device and methods for manufacturing sandwich wall panels and double wall panels employing the disclosed load transfer device.

22 Claims, 31 Drawing Sheets

LOAD TRANSFER DEVICE

CROSS-REFERENCE TO RELATED APPLICATIONS

This application is a continuation of U.S. Nonprovisional patent application Ser. No. 13/468,167, filed on May 10, 2012, the entire disclosure of which is hereby incorporated by reference. U.S. Nonprovisional patent application Ser. No. 13/468,167 claims priority from U.S. Provisional Patent Application Ser. No. 61/484,966, filed May 11, 2011, entitled X-SHAPED LOAD TRANSFER DEVICE, the contents of which is hereby incorporated in its entirety by reference.

FIELD OF THE INVENTION

This application relates generally to connectors and load transfer devices for interconnecting components, such as pavement or the structural components of a building, including the concrete wythes and insulation of a concrete sandwich wall panel or double wall panel roof and floor members, balconies, canopies, and other insulated connections.

BACKGROUND

Sandwich wall panels, also called integrally insulated concrete panels, are well known in the construction industry. Most sandwich panels are composed of interior and exterior concrete layers, called wythes, and one or more insulation layers between the two concrete layers. The insulation layer is generally rigid insulation, such as expanded or extruded polystyrene or polyisocyanurate. Also included in the sandwich wall panel are connectors that connect the two concrete wythes through the layer(s) of insulation. The connectors hold the components of the sandwich wall panel together and also provide a mechanism whereby loads can be transferred between the components of the wall and the structure's foundation. Common loads include tension, shear, and moments induced by wind, gravity, and seismic loads, as well as combinations thereof. In composite and partially composite sandwich wall panels, connectors must cause the two concrete wythes to function together as one structure. Depending on the application, load transfer devices may be many different shapes and composed of many different materials. One material in particular, metal has beers used in the past, but metal has undesirable thermal connectivity properties and may suffer corrosion in some situations. These problems can also be present in sandwich panels containing metal trusses or reinforcing. Accordingly, there is a need in the art for a shear connector and load transfer device that reduces the need for metal components to be used as connectors and trusses.

Alternatively, non-composite insulated concrete sandwich walls allow the components of the sandwich wall to work independently of each other. Generally, there is a structural concrete wythe, an insulation layer, and an architectural exterior wythe. The independent behavior eliminates problems associated with large temperature differentials between interior and exterior wythes and the thermal bowing that can be present in some structural composite panels.

Sandwich wall panels can be manufactured in a variety of ways known, in the art. The entire panel may be manufactured in a plant and transported to a job site, a process known as plant precast. The panel may be constructed on the ground at the job-site and then tilted up and into place, a process known as site-cast tilt-up. Sandwich, walls may also be vertically cast in place at the job site, commonly known as cast-in-place construction or vertically cast in a precast factory as part of the individual rooms of a building, this method is commonly known as modular precast construction. Accordingly, the panels may be constructed in both a vertical and horizontal manner.

Also known in the industry are double wall panels, which can provide weight and structural connection improvements over traditional sandwich panels. In addition to interior and exterior concrete wythes and an insulation layer, a double wall panel also includes an air void, also called an air gap. Oftentimes, the air void is filled with concrete and/or additional insulation materials or another material upon delivery to the job site. Because double wall panels are typically lighter than sandwich panels, double wall panels may cost less to manufacture and ship. Because of these advantages, double wall panels may be manufactured to a larger size prior to shipment.

Sandwich and double wall panels may reduce the energy requirements of buildings and are becoming more popular as energy conservation is a growing concern among building owners and is increasingly present in construction codes. Integration of thicker insulation can provide even higher energy savings. Sustainable building construction Is also gaining in popularity. Sandwich panels can provide means for sustainable construction by providing structural composite panels, increasing the thickness of the insulation, and reducing wythe thickness. However, sandwich panels with these features require use of either more or stronger connectors. Accordingly, there is a need in tire industry for a connector to provide the strength necessary for these applications.

Green roofs are known in the industry and are growing in popularity. In this application, the roof slab should be insulated and provide a watertight surface. Oftentimes, these issues are addressed by including a layer of insulation between two concrete layers. Additionally, floor slabs present many of the same issues. The load transfer devices connecting the components of the roof and floor slabs must transfer the necessary loads and be thermally non-conductive so as to prevent condensation on the roof and floor slabs.

In addition, the double wall panels discussed above require devices such as standoff connectors to define the thickness of the double wall panel and/or support the weight of one of the concrete wythes during the manufacturing process. Accordingly, there is a need in the industry for a shear connector that can provide these functions in addition to connecting the components of the double wall panel and transferring loads between same.

As is known in the art, sandwich wall panels may be constructed either horizontally or vertically. When constructed horizontally, a first concrete layer is poured, and the insulation layer is placed on top of the wet concrete layer. The insulation layer is designed to receive the connectors or ties that will be used to interconnect the components, usually having precut or pre-machined holes. Oftentimes, these holes are much larger than the connectors themselves. This decreases the thermal efficiency of the panel and may require application of another insulation, such as foam insulation, to fill the remaining volume of the hole not taken up by the connector. Moreover, connectors of the prior art are designed to be placed between side-by-side sections of insulation, leaving behind gaps in the insulation layer that must be filled with another insulation. Accordingly, there is a need in the industry for a shear connector that will eliminate the need to fill the space remaining in the insulation after insertion of the connectors. Sandwich panels that are constructed vertically are often constructed using a method known as "cast-in-place". In this method, the walls are created at their service location. Vertical forms are erected, and the insulation and connectors are placed into the vertical forms. The vertical forms are open at the top. Both layers of concrete are then poured simultaneously from the top of the forms. Alternatively, the concrete may be pumped Into the form from rate or more openings near the bottom. Accordingly, the concrete surrounds the insulation as in the horizontal methods of manufacture.

Connectors of the prior art are connected to internal reinforcing, which makes installation difficult. Accordingly, there is a need in the art for a connector that is a load transfer device that does not require connection, to reinforcing or use of trusses in the wall panel and, therefore, provides ease of assembly and installation. In addition, there is a need in the art for a load transfer device that is composed of discrete load transfer members that can be selectively positioned as the application requires. Moreover, there is a need in the art for a load transfer device which, provides for simple and cost-effective handling and transport.

Accordingly, a load transfer device is provided that is also a shear connector which can be used in all methods of manufacturing concrete sandwich and double wall panels, including vertical, horizontal, and modular methods. The shear connector of the present invention provides increased strength and load transfer properties over the prior art. Additionally, the present connector eliminates the need to provide foam or other insulation to fill voids left in the Insulation layer after insertion of the connector, the connector is thermally nonconductive. Further, the connector can reduce or eliminate the need to include trusses that span the insulation layer. The connector can provide a standoff or spacing function during the manufacture of double wall panels. Further, the connector holds the concrete wythes of the panel from shifting during handling and transport. The connector provides for simple and cost-effective handling and transport. The load transfer device of the present application provides superior shear transfer capacity and can be placed easily in rigid insulation material.

SUMMARY

The present invention provides a load transfer device, which is a shear connector for interconnecting components, such as the components of wall panels, including sandwich wall panels and double wall panels, and transferring the loads placed upon the connected components. The device includes at least two load transfer members that, in a sandwich wall panel, each span the insulation layer and extend into the two concrete wythes. In a double wall panel, the load transfer device of the present invention spans the insulation and air void layers, extending into the concrete layers. The two load transfer members are positioned at a selectively adjustable angle with respect to one another and to the normal of the plane at which the components meet. In many embodiments, the load transfer members of the load transfer device cross each other. However, in some applications, the load transfer members may not cross each other.

The invention also provides a retention housing, which may be manufactured in one or more pieces. Preferably, the retention housing is made of rigid insulation material. The retention housing fills the voids in the insulation layer for inserting the load transfer device and also provides a means, such as a recessed portion cut in the rigid insulation, for retaining the load transfer members at the proper angle. Optionally, a depth locator may be used to provide a means for inserting and retaining the members at the proper depth during the manufacturing or building process. The load transfer members may include means to anchor the connector in the components of the wall panel. For example a groove or a hole, alone or in combination with short members that extend into the concrete, may be used for anchoring purposes.

Also included in the present invention is a sandwich wall panel employing the load transfer device. The sandwich wall panel of the present invention includes interior and exterior concrete layers, an insulation layer, and at least one load transfer device. The load transfer device is a shear connector and provides for load sharing between the components of the sandwich wall panel. Because the load transfer device is thermally nonconductive, the sandwich wall panel of the present invention provides superior thermal properties. A method for manufacturing the sandwich wall panel is disclosed, which includes cast-in-place, vertical, horizontal, and modular methods. The sandwich panel may or may not include reinforcing or trusses. In the preferred embodiment of the method, the insulation is disposed to receive a rectangular cuboid-shaped retention housing made of insulation. The retention housing is disposed to accept load transfer members of the exact shape and size to be used in the application. Accordingly, the method does not include the need for additional foam or other types of insulation to fill space not taken up by the load transfer device.

Further disclosed is a double wall panel using the load transfer device. The double wall panel includes interior and exterior concrete wythes, an insulation layer, and an air void. The air void may be filled with another material, such as concrete and/or additional insulation materials, if desired. The double wall panel may or may not include reinforcing or trusses. A method for manufacturing the double wall panel is disclosed, which includes plant precast double wall panels, double wall panels constructed at the job site, and double wall panels manufactured both on and off the job site. In addition to being a shear connector, the load transfer device of the present invention may provide a standoff function, which means that it can be used to define the thickness of the double wall panel and support part of the double wall panel during the manufacturing process. In the method, first concrete and insulation layers are provided. At least one load transfer device is inserted into the insulation and wet concrete. Another concrete layer is then provided, leaving space for an air void between the insulation layer and second concrete layer. In the preferred embodiment, upon curing, the first concrete and insulation layers and the load transfer device(s) are lifted, rotated 180 degrees, and lowered into a second, wet concrete layer such that the load transfer members of the load transfer device(s) extend into the new concrete layer while leaving the air void. In this method, the load transfer device provides means for supporting the first concrete and insulation layers while they are elevated above the second concrete layer.

BRIEF DESCRIPTION OF THE DRAWINGS

FIG. 21 is an illustration of the method for manufacturing a sandwich wall panel, wherein load transfer members have been inserted into the retention housings in accordance with the present invention.

DETAILED DESCRIPTION

The following is a detailed description of an embodiment of a load transfer device 100, sandwich wall panel 200, methods for manufacturing a sandwich wall panel, double wall panel 300, and a method for manufacturing a double wall panel of the present invention. For ease of discussion and understanding, the following detailed description and illustrations refer to the load transfer device 100 for use with wall panels, namely, concrete sandwich wall panels and double wall panels. It should be appreciated that the load transfer device 100 may be used to interconnect components of other structural building components, such as roof floor, balcony, and canopy members, and in other concrete applications. For example, the load transfer device 100 may also be used to connect and transfer loads in concrete pavement applications. The load transfer device 100 of the present invention is sometimes illustrated and described in an embodiment where two load transfer members 102, 104 form an "X" shape. However, it should be appreciated that more than two load transfer members may be employed. Furthermore, the load transfer members 102, 104 need not form an "X".

Figure 1:
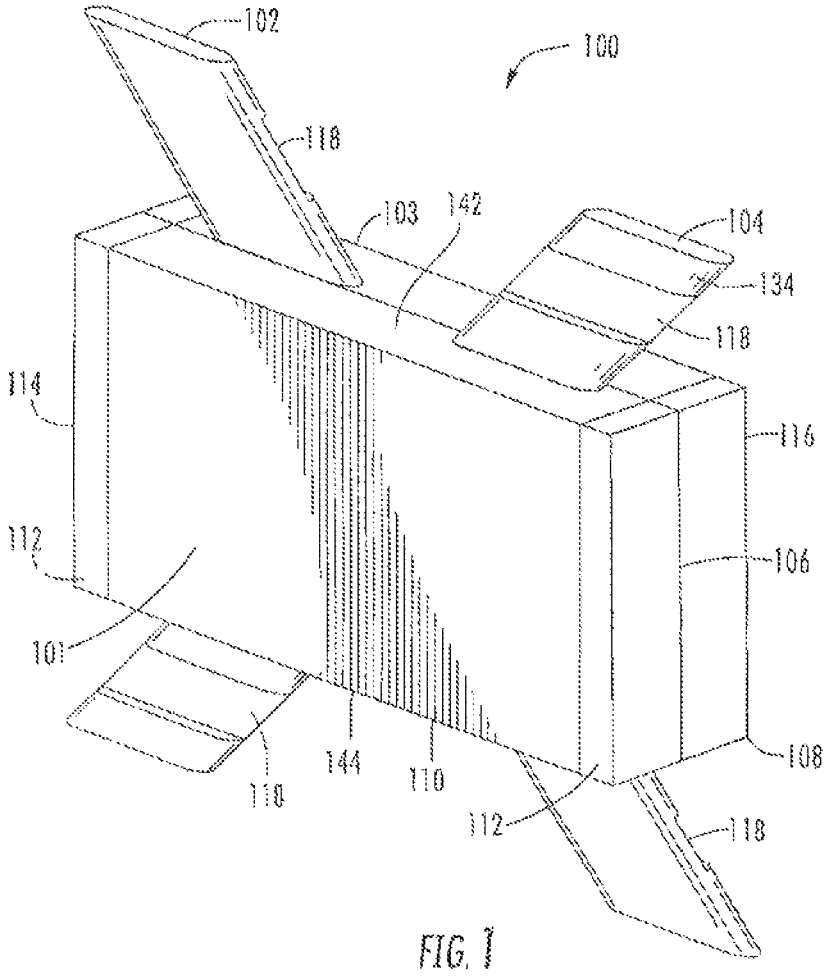
FIG. 1 is a perspective view according to one embodiment of a load transfer device of the present invention.

Referring to FIG. 1, a load transfer device 100 of the present invention is shown. The load transfer device 100 is primarily a shear connector. The load transfer device 100 includes a first load transfer member 102 and a second load transfer member 104. In the preferred embodiment and the illustration shown, the load transfer members 102, 104 are elongated, flat, linear bars, the ends of which are embedded in and connect first and second concrete elements. As can be seen in FIG. 1, the ends extending into the same concrete element are positioned in a spaced relationship with one another. However, one of skill in the art will recognize that the load transfer members 102, 104 may be any elongated shape with any shape cross-section as the application may so require without departing from the scope of the present invention. It is contemplated that the load transfer members 102, 104 will be made of a material of sufficient strength to hold and transfer the required loads. In the preferred embodiment, the load transfer members 102, 104 are made of fiber reinforced polymer material, although one of skill in the art will recognize that the load transfer members 102, 104 may be made from any appropriate material. For best results, a thermally nonconductive material should be used. In applications where concrete components are to be interconnected, the preferred fiber reinforced polymer expands and contracts at the same rate as concrete when exposed to differing thermal conditions. In the preferred embodiment, the load transfer members 102, 104 are identical and may be interchanged during assembly of the load transfer device 100, which provides for cost and time savings in the manufacturing process, and ease of assembly in the construction process. One of skill in the art will recognize that the load transfer members 102, 104 need not be identical and may differ from each other depending on the application. In its simplest form, the load transfer device 100 includes the load transfer members 102, 104 as its only components. Optionally, the load transfer members 102, 104 may each include a collar to appropriately position the load transfer members 102, 104 in the sandwich panel. However, in the preferred embodiment, the load transfer device 100 includes further components, including a depth locator 120, which provides means for locating the load transfer members 102, 104 at the appropriate depth in the concrete elements they are connecting, and a retention housing 106, which provides means for retaining the load transfer members 102, 104 at their appropriate angle within the concrete elements. In the embodiment illustrated in FIG. 1, two load transfer members 102, 104 are shown. As will be discussed below, it is contemplated that more than two load transfer members 102, 104 may be used. Further, the load transfer members 102, 104 may not cross at their centers or at all.

As is shown in FIG. 1, the load transfer device 100 may include a retention housing 106. In the preferred embodiment for use with wall panels, the retention housing is made of insulating material. The retention housing 106 is preferably made of the same material as the rigid insulation layer of the wall panel, although it may be made of a different insulating material. In the preferred embodiments the retention housing 106 is made of a first retention, member 108 and a second retention member 110. One skilled in the art will recognize that the retention housing 106 may be made of any number of insulation pieces. The retention housing 106 has a front surface 101, back surface 103, left side 114, right side 116, top 142, and bottom 144. The two retention members 108, 110 may be held in place by adhesive or other connecting means, including mechanical means. In the preferred embodiment the retention members 108, 110 are held together at the left side 114 and right side 116 by a strip of self-adhesive tape 112 that wraps all the way around the perimeter of the left side 114 and right side 116. When assembled, the load transfer members 102, 104 extend outward in opposite directions from said retention housing 106. The load transfer members 102, 104 may include one or more anchoring means 118. The anchoring means 118 help anchor the load transfer members 102, 104 in the concrete or other components to be connected. As is shown in FIG. 1, the anchoring means 118 may be a horizontal groove cut in the load transfer members 102, 104, near both the top and bottom ends, such that the grooves will be in communication with the concrete of a sandwich panel. In the preferred embodiment, the anchoring means 118 are located on the exterior surface 134 of the load transfer member 102, 104, although they may be located on the interior surface. As will be discussed in more detail other anchoring means 118 may also be employed.

Figure 2:
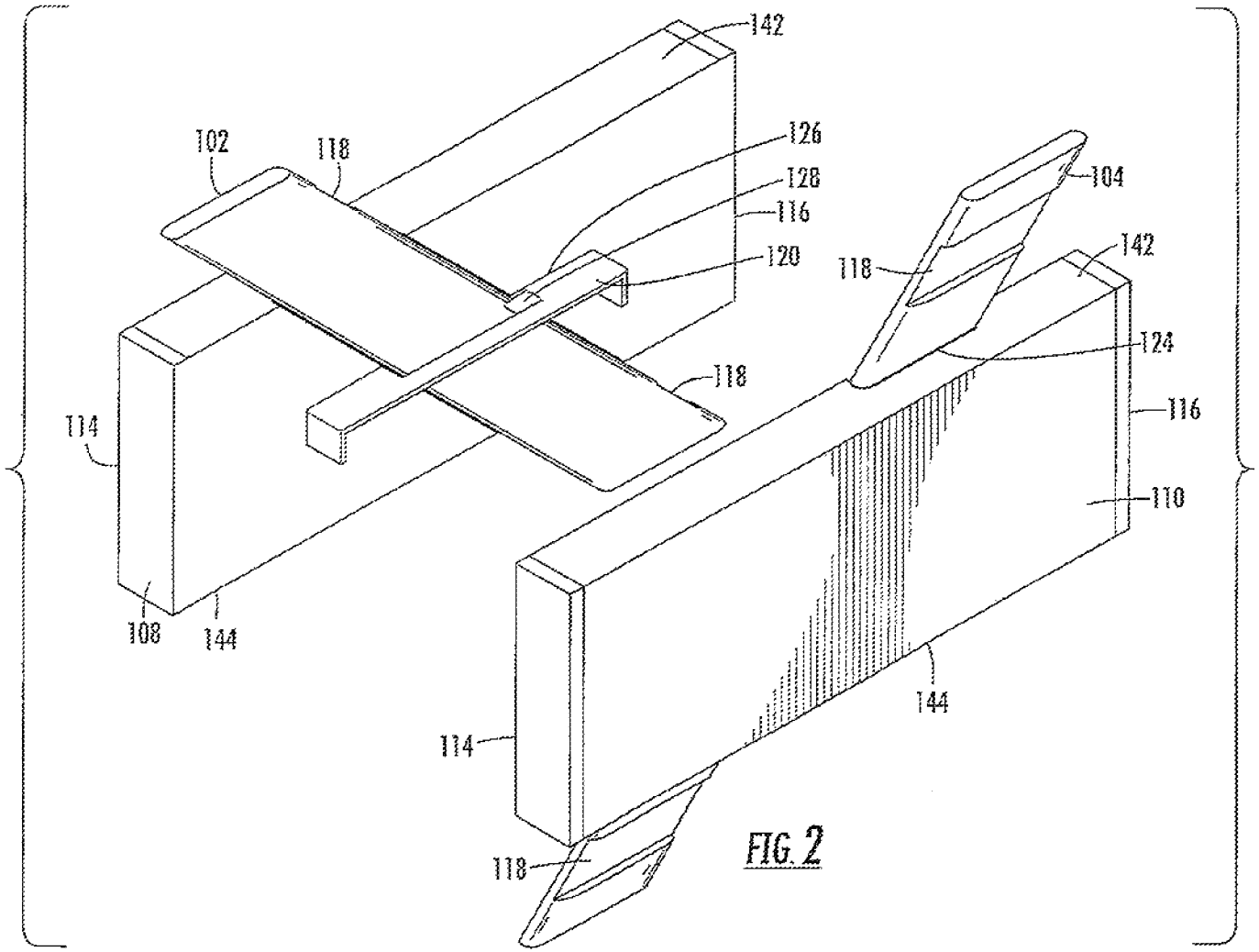
FIG. 2 is an exploded view of the load transfer device of FIG. 1.

FIG. 2 provides an exploded view of components of the load transfer device 100. Specifically, FIG. 2 shows the first and second retention members 108, 110, the first and second load transfer members 102, 104, and the depth locator 120. The retention members 108, 110 each have a left side 114, right side 116, top 142, and bottom 144, corresponding to the same sides on the assembled retention housing 106 of FIG. 1. Referring again to FIG. 2, the retention members 108, 110 may optionally include a recessed portion 122, 124 to accept the load transfer members 102, 104. Recessed portion 124 is shown in FIG. 2. Recessed portion 122 is blocked from view as it is located directly behind load transfer member 102. The retention members 108, 110 and the recessed portions 122, 124 may be formed by any method, now known in the art or later developed, such as but not limited to pre-machining or molding. Further, the load transfer device 100 may include a depth locator 120. The depth locator 120 is held in place by a channel 120 in the first retention member 108 and a channel 126 in the second retention member 110. The channel 120 can be seen in the first retention member 108 in FIG. 2. The channel 126 in the second retention member 110 is identical to the channel 126 in the first retention member 108, but is not shown in FIG. 2 due to the angle. The depth locator 120 is designed to accept the first and second load transfer members 102, 104 and lock same in place using a pair of slightly flexible tabs 128, 130. The load transfer members 102, 104 each include a first 132 and second indentation 133, which can be seen in FIG. 6. Referring again to FIG. 2, the load transfer members 102, 104 are each inserted from the top 142 of the retention housing 106. The load transfer members are inserted until the tab 128 or 130 snaps into the first indentation 132 and locks into place. When the load transfer members 102, 104 have reached their appropriate depth, the tab 128 or 130 and its corresponding indentation 132 create an audible noise, letting the user know that the load transfer member 102 or 104 has been inserted to the appropriate depth. As one skilled in the art will appreciate, the appropriate depth is important for proper anchorage in the concrete wythes and is determined depending that the application. Accordingly, the position of the indentations 132, 133 will vary with the application.

Figure 3:
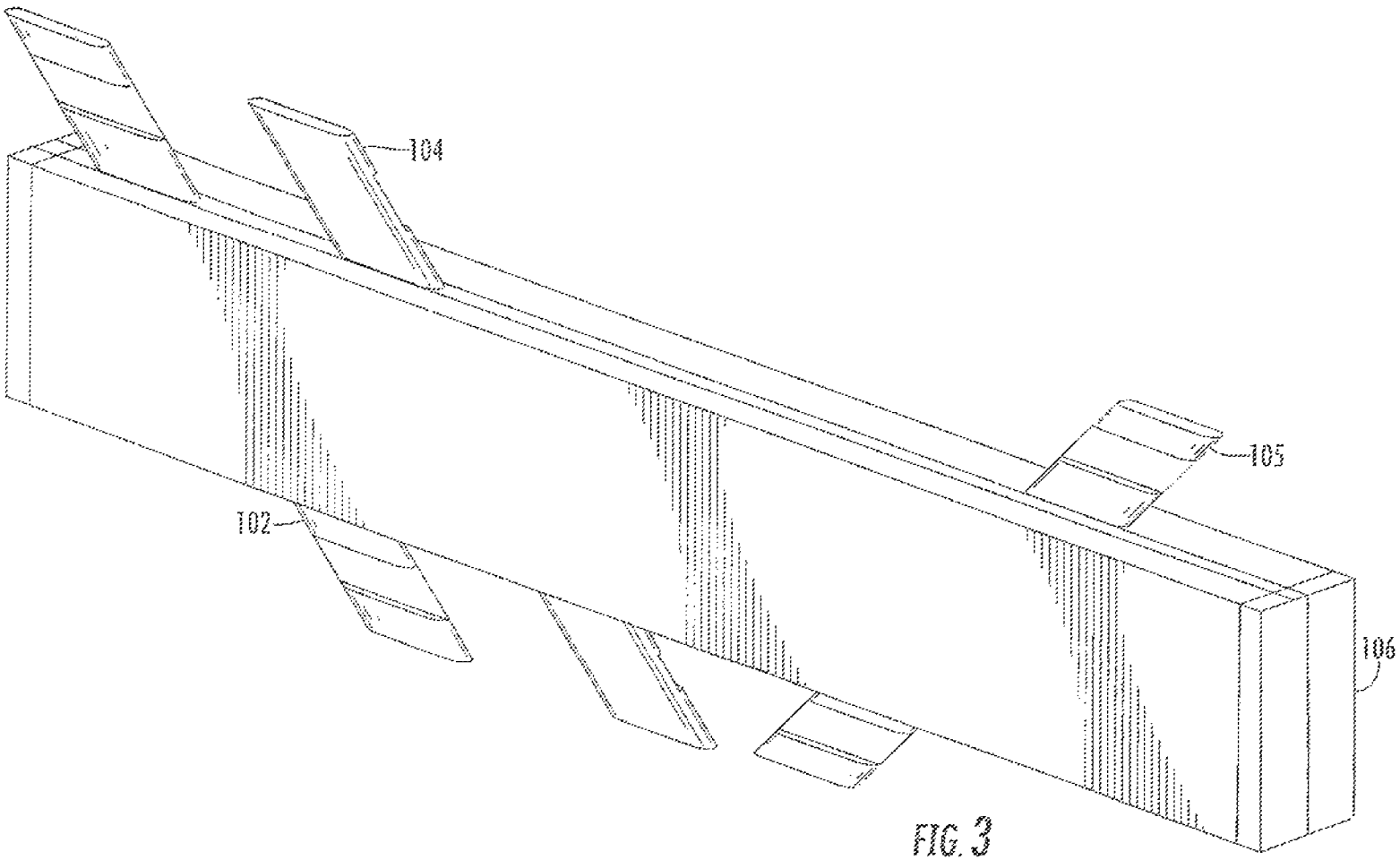
FIG. 3 is a perspective view of a second embodiment of a load transfer device of the present invention.
Figure 4:
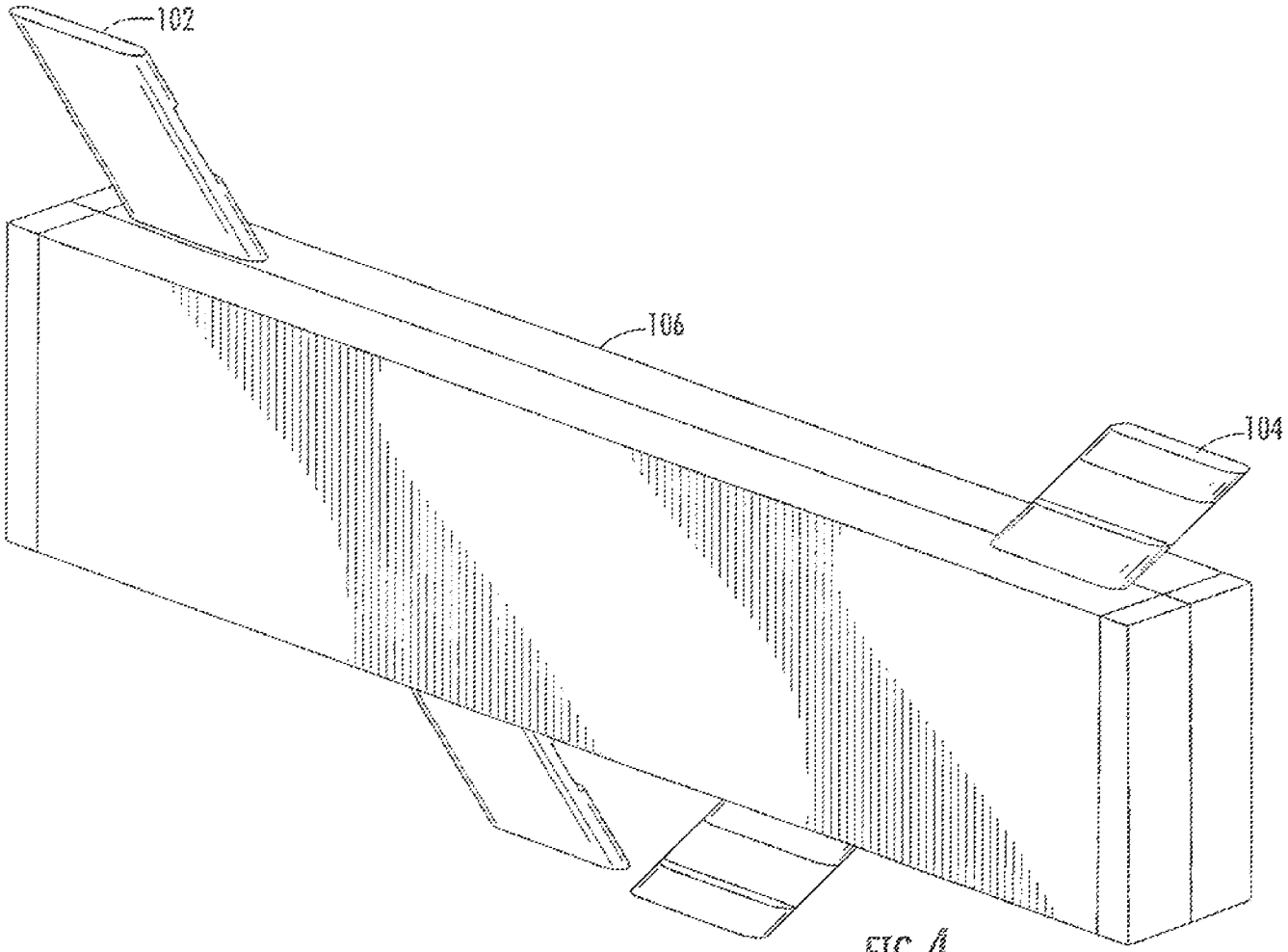
FIG. 4 is a perspective view of a third embodiment of a load transfer device of the present invention.
Figure 5:
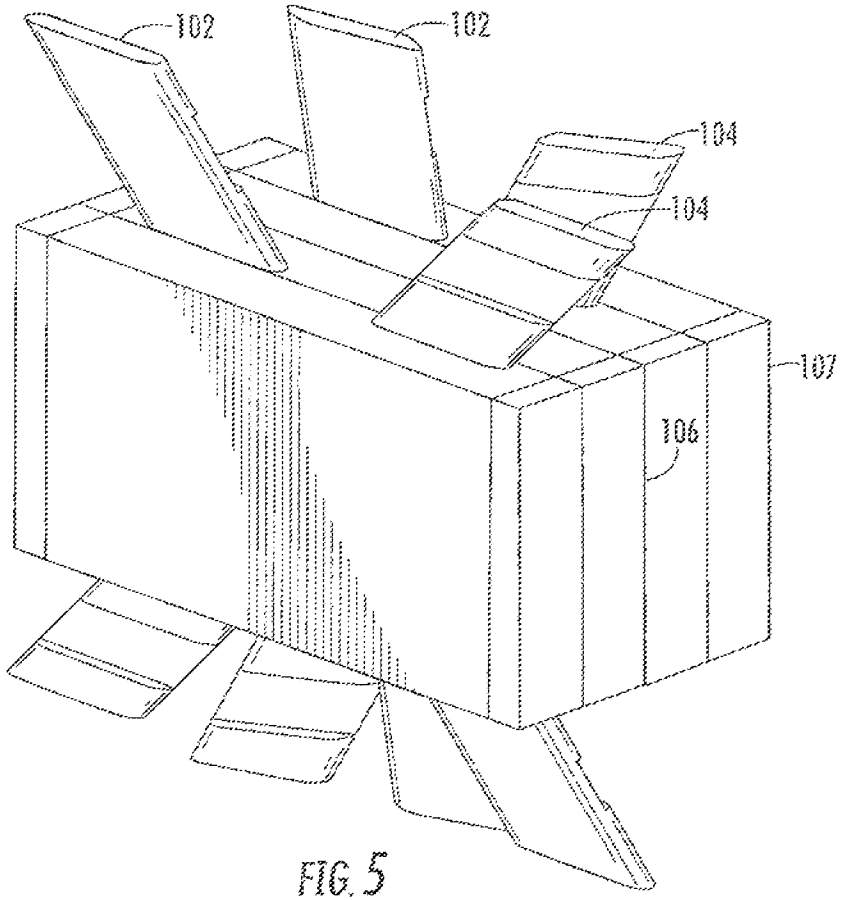
FIG. 5 is a perspective view of a fourth embodiment of a load transfer device of the present invention.

The embodiment shown in FIGS. 1 and 2 includes two load transfer members 102, 104 which cross each other at their center. Depending on the application, the load transfer device 100 may include more than two load transfer members 102, 104. In addition, the load transfer members 102, 104 need not cross each other. Because the load transfer members 102, 104 are independent, discrete components, the user may construct the load transfer device 100 of the present invention to provide greater load transfer capacity in necessary areas of the application. Illustrated in FIG. 3 is a load transfer device 100 of the present invention wherein the retention housing 106 is long enough to accommodate three load transfer members 102, 104, and 105. Also shown in FIG. 3, the anchoring means 118 may be positioned to face inward, outward, or a combination of the two. FIG. 4 provides an illustration of an embodiment wherein two load transfer members 102, 104 are provided that do not cross each other. FIG. 5 illustrates an embodiment wherein two retention housings 106, 107 and four load transfer members 102, 104 are used. The second retention housing 107 is located in-line with the first retention housing 106. In the illustrated embodiment, the two retention housings 106, 107 are located parallel to each other. However, the retention, housings 106, 107 may be located at angle with respect to each other. As can be seen in the FIG. 5, the load transfer members 102, 104 need not be positioned at the same angle. The retention, housings 106, 107 may include any number of load transfer members 102, 104 located at any position. Furthermore, the user need not use two separate retention housings 106, 107 to create the load transfer device illustrated in FIG. 5. Rather, one retention housing 106 that can receive numerous load, transfer devices may be used.

Figure 6:
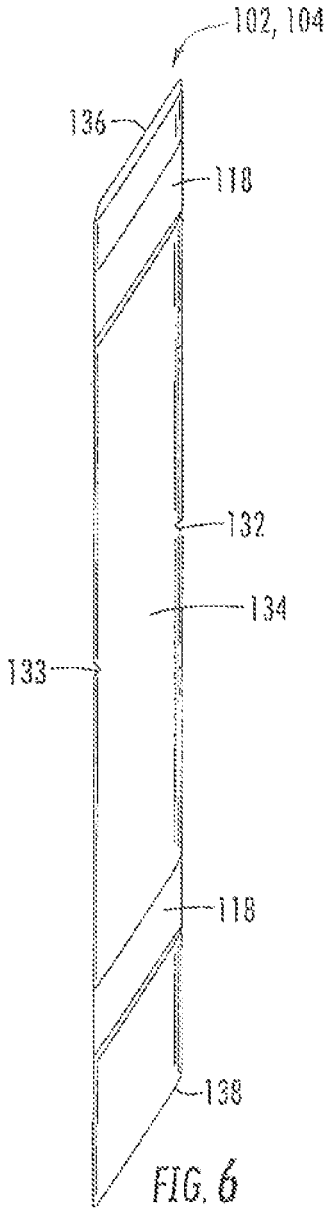
FIG. 6 is a perspective view of the front face of a load transfer member of the load transfer device of FIG. 1.
Figure 7:
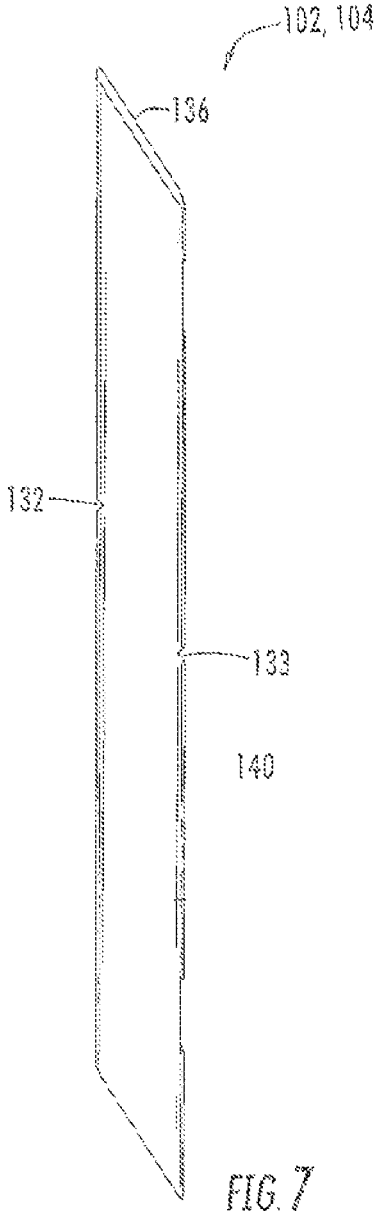
FIG. 7 is a perspective view of the back face of a load transfer member of the load transfer device of FIG. 1.

FIGS. 6-7 provide further illustrations of the load transfer members 102, 104. In the preferred embodiment, the load transfer members 102, 104 are identical. Accordingly in FIGS. 6-7, one load transfer member is shown to represent all. However, one skilled in the art will recognize that the load transfer members 102, 104 need not be identical, which may be advantageous depending on the application. FIG. 6 shows the exterior lace 134 of a load transfer member 102, 104. In the illustrated embodiment, the exterior face 134 of the load transfer member includes two anchoring means 118. As is shown in FIG. 1, the exterior lace 134 of the load transfer member 102, 104 faces outward when inserted into the retention housing 106 and depth locator 120. Referring again to FIG. 6, the load transfer members 102, 104 each include two indentations 132, 133. The first indentation 132 communicates with and accepts the appropriate tab 128, 130 of the depth locator 120. The second indentation 133 is provided for versatility, allowing the load transfer member 102, 104 to be used interchangeably. The load transfer members 102, 104 each include a top edge 136 and a bottom edge 138. In the exemplary load transfer members 102, 104 shown in FIGS. 6-7, the top edge 136 and bottom edge 138 are each finished at an angle such that when the load transfer members 102, 104 are inserted into the retention housing 106 and depth locator 120, the top edge 136 and bottom edge 138 are generally parallel to the planar surface of the concrete wythes of a sandwich panel. Accordingly, the shape and angle of the top edge 136 and bottom edge 138 will vary depending on the angle at which the load transfer members 102, 104 are positioned. Further, the top edge 136 and bottom edge 138 need not be parallel to the planar surface of the connected components, which may be particularly desirable in an embodiment wherein the components of a double wall panel are connected, or in a pavement application.

FIG. 7 shows the back face 140 of a load transfer member 102 or 104. As is shown in the drawing, the back does not include anchoring means 118 in this embodiment. However, one skilled in the art will appreciate that anchoring means 118 may also be included on the back of the load transfer member 102, 104. As can be seen in FIG. 7, the first indentation 132 and second indentation 133 extend all the way through and also cut out the back face 140 of the load transfer member 102, 104.

Figure 8:
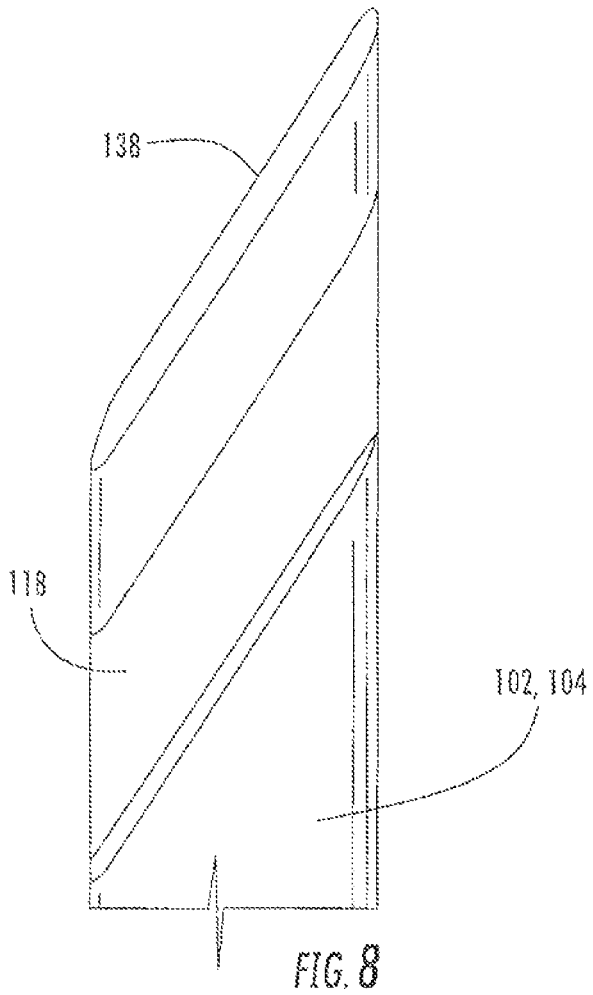
FIG. 8 is a perspective view of the anchoring groove of the load transfer device of FIG. 1.
Figure 9:
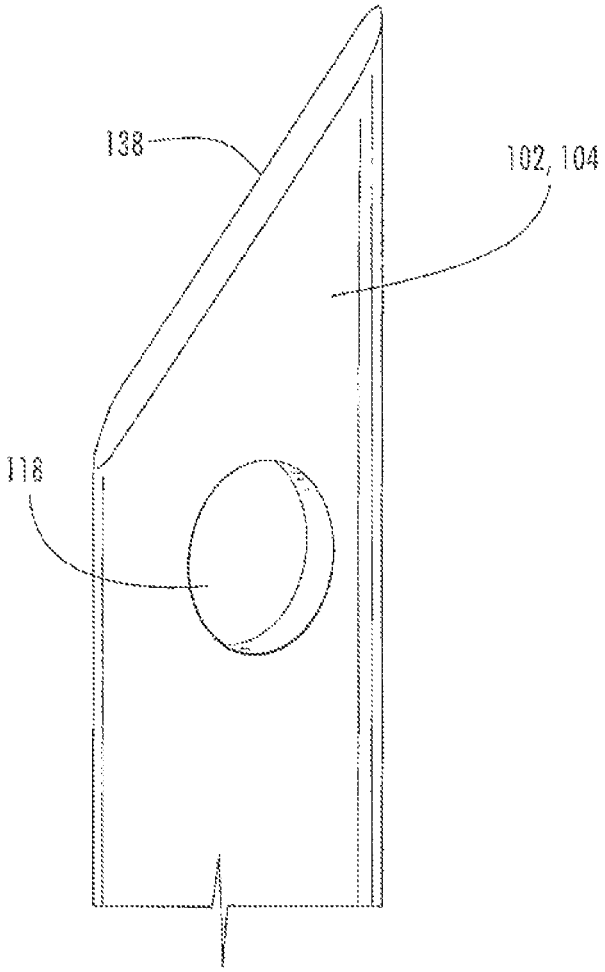
FIG. 9 is a perspective view of an alternate embodiment of an anchoring means of the load transfer device.
Figure 10:
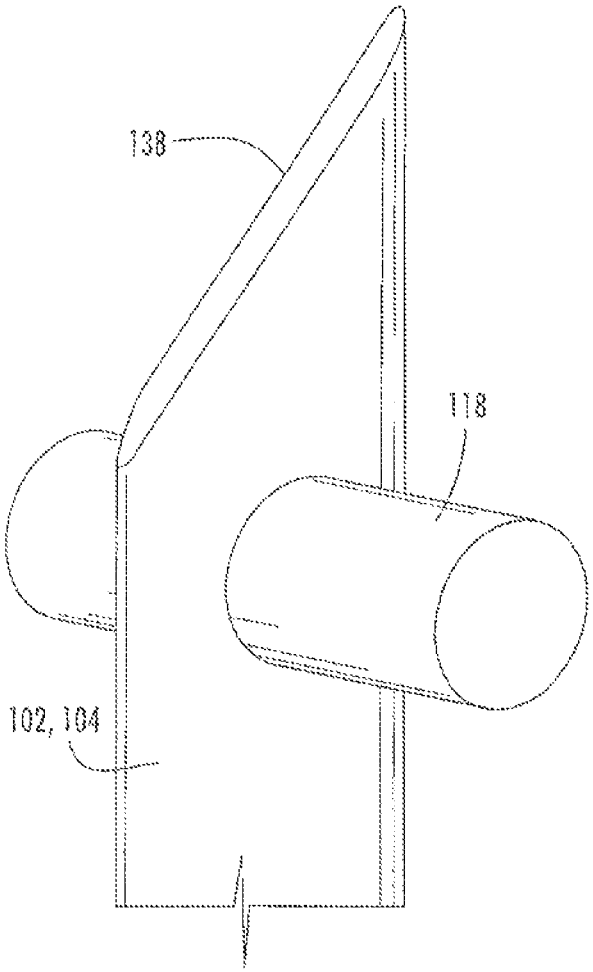
FIG. 10 is a perspective view of a second alternate embodiment of an anchoring means of the load transfer device.

FIG. 8 shows one example of an anchoring means 118 on a load transfer member 102 or 104. The anchoring means 118 is a depression located near the bottom edge 138 (or identically, on the top edge 136) of the load transfer member 102 or 104. The depression extends about one third of the depth of the load transfer member 102 or 104. The component to be connected, such as the concrete wythes of a sandwich panel or double wall panel loan around the depression, thereby anchoring the load transfer member 102, 104 in the concrete or other component to be connected. One skilled in the art will appreciate that the depression may be any shape or depth necessary for the application and may be moved to a different location on the load transfer member 102 or 104 as the application may require. In addition, other anchoring means 118 known now or in the future may be employed, such as a hole drilled in the load transfer member 102 or 104, as illustrated in FIG. 9. In another embodiment of the anchoring means 118, a short piece of reinforcing bar is placed through a hole drilled in the load transfer member 102 or 104, as shown in FIG. 10. The reinforcing bar is not part of the optional reinforcing network generally found in the concrete layers of sandwich panels, but is rather a short piece that allows concrete to cure around it, thus anchoring the load transfer member 102 or 104 in the concrete or other component to be connected.

Figure 11:
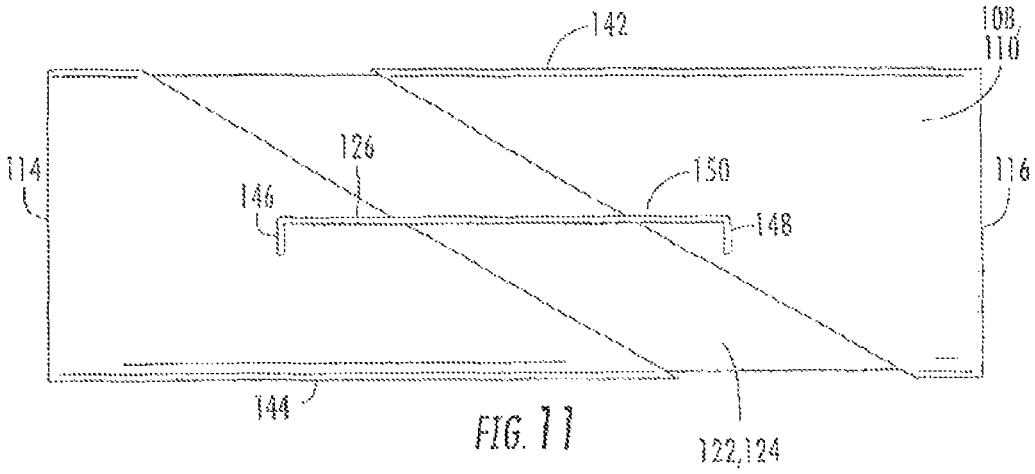
FIG. 11 is a front elevation view of a retention member of a retention housing of the load transfer device of FIG. 1.

FIG. 11 shows a retention member 108 or 110. The retention housing 106, and accordingly the retention members 108, 110 are designed to retain the load transfer members 102, 104 at their proper angles. The retention housing 106, including the retention members 108, 110, is generally made of a rigid insulation material, including, but not limited to, expanded or extruded polystyrene, polyisocyanurate, and high density rock wool. One skilled in the art will appreciate that the retention housing 106 may be made of any material, particularly any type of insulating material. Further, the retention housing 106 may be manufactured in any number of pieces, including one complete retention housing or two or more retention members. The retention members 108, 110 shown in FIGS. 1-2 are identical. However, when the load transfer device 100 is assembled, the two identical retention members 108, 110 face each other such that the recessed portions 122, 124 to accept the load transfer members 102, 104 and channels 126 to accept the depth locator 120 face each other. Accordingly, when assembled, the two recessed portions 122, 124 are X-shaped and cross each other rather than being parallel to each other. However, depending on the application, the configuration of the recessed portions 122, 124 may differ from the described embodiment. The channels 126 are identical and directly across from each other such that they may accept the same depth locator 120. The retention member 108, 110 includes a top 142, bottom 144, left side 114, and right side 116. As is shown in FIG. 11, the channel 126 to accept the depth locator 120 includes two vertical portions 146, 148 at the ends of a single, horizontal portion 150. The vertical portions 146, 148 extend downward from the horizontal portion 150 toward the bottom 144 of the retention member 108, 110. Optionally, the retention housing 106 and accordingly the one or more retention members 108, 110 may be tapered to prevent the retention housing from slipping through the insulation layer of a sandwich or double wall panel during construction.

Figure 12:
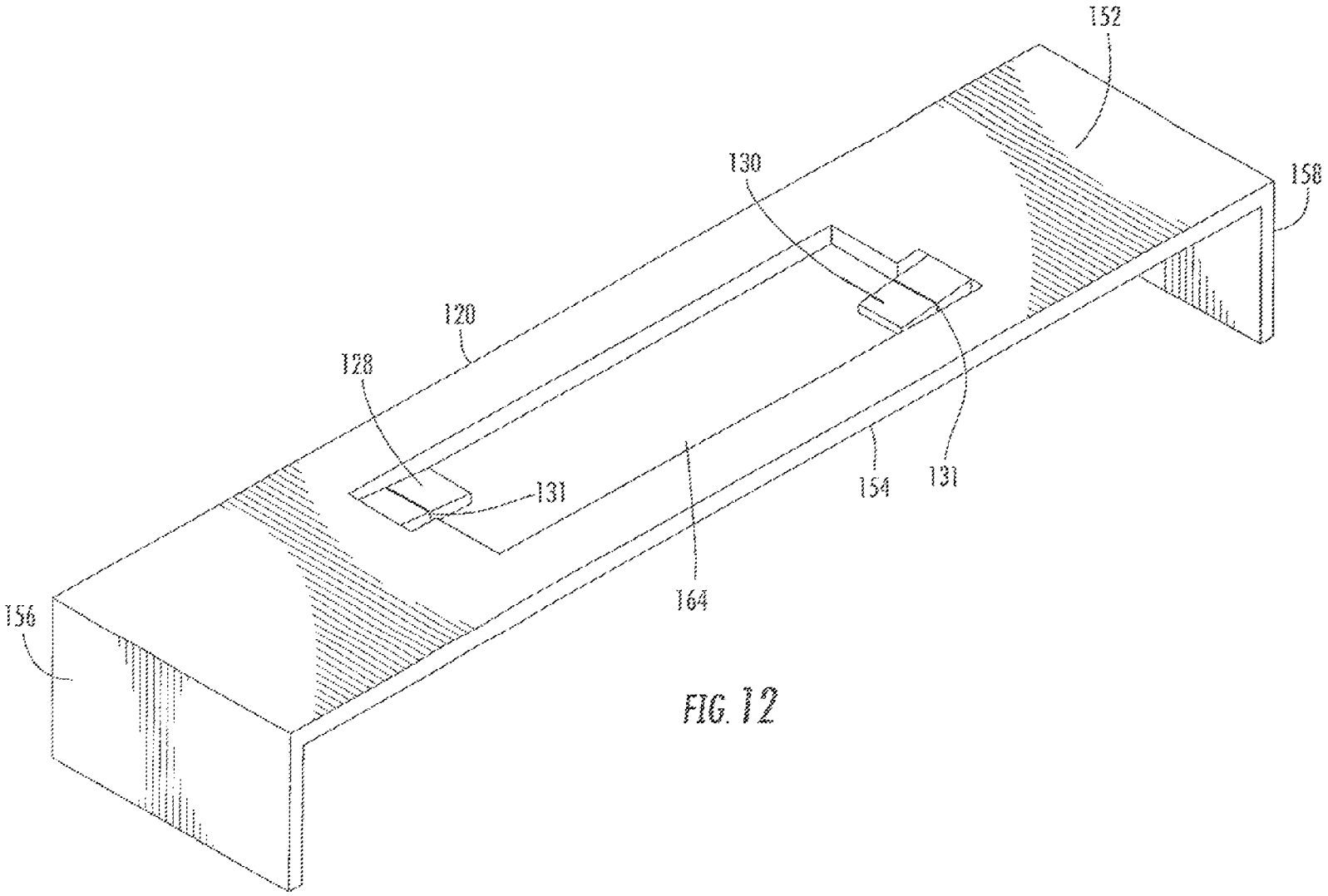
FIG. 12 is a perspective view of a depth locator of the load transfer device of FIG. 1.

Illustrated in FIG. 12 is an embodiment of the depth locator 120. The depth locator acts as a retention device to retain the load transfer members at their appropriate depth in the concrete layers. As one skilled in the art will recognize, the appropriate depth may vary depending on the application. The depth locator 120 includes a planar member having a top surface 152 and bottom surface 154. Further a left leg 156 and a right leg 158 are present and extend downward from the bottom surface 154 of the depth locator 120. In the preferred embodiment, the depth locator 120 is symmetrical such that it is identical when rotated 180° in the horizontal plane. However, one of skill in the art will recognize that the depth locator 120 may not be symmetrical in certain applications. The depth locator 120 includes a cutout portion 164, through which the two load transfer members 102, 104 can be inserted. The depth locator 120 includes two tabs 128, 130 protruding from the perimeter of the cutout portion 164. As is shown in FIGS. 6-7, the load transfer members 102, 104 include indentations 132, 133. When the first indentation 132 meets the appropriate tab 128 or 130 the parts click into place. The user will hear an audible noise signaling that the load transfer members 102, 104 have reached their appropriate depth. In the preferred embodiment, the load transfer members 102, 104 may only move downward through the depth locator 120. Once the load transfer members 102, 104 are inserted, upward movement of the load transfer members 102, 104 will cause the tabs 128, 130 to snap and break. As is shown in FIG. 12, the tabs 128, 130 may taper slightly to accommodate movement of the load transfer members 102, 104 through the depth locator 120. Optionally, as shown by tab 130, the tabs may include a hinge joint 131 to accommodate movement of the load transfer members 102, 104 through the depth locator and into place. Accordingly, the depth locator 120 provides a means to assist the user in correctly assembling the load transfer device 100 and also to retain the load transfer members 102, 104 at the appropriate depth.

The angle at which the load transfer members 102, 104 are each positioned is precise, but adjustable. Generally, angles of 20° to 70° from normal may be used, with 30° to 60° angles from normal providing optimal load transfer properties, as the force resisted at those angles is mostly tension. In a sandwich wall or double wall panel, the load transfer members 102, 104 are each positioned at art angle to the normal of the plane at which the layers meet. In addition, the load transfer members are each positioned at an angle to the planar surface of the concrete layers. However, one of skill in the art will recognize that load transfer members 102, 104 may be positioned at any angle. In addition, one of skill in the art will recognize that the angle will vary depending on the application and other factors, such as the loads to be transferred and, in a wall panel application, the thickness of the various layers. In the provided illustrations, oftentimes the load transfer members 102, 104 cross each other at their center. One of skill in the art will recognize that the load transfer members 102, 104 need not cross at their center, which may be advantageous in some applications, such as a double wall panel. In addition, the load transfer members 102, 104 need not cross at all.

In its simplest form, the load transfer device 100 consists of the two load transfer members 102, 104. The load transfer members 102, 104 can be inserted into components to be connected, such as the sections of pavement or the concrete of a wall panel. If the user desires, the retention housing 106 and/or depth locator 120 may also be employed. The retention housing, as will be discussed below, is particularly useful in applications involving wall panels that include a layer of insulation. The device 100, when using the depth locator 120 and retention housing 106 is assembled by sliding the depth locator 120 into the channel 126 of the first retention member 108 and then the channel 126 of the second retention member 110. The vertical portions or legs 156, 158 of the depth locator 120 should extend toward the bottom 144 of the first retention member 108. The second retention member 110 should then be inserted around the depth locator 120 such that the depth locator 120 is inserted into the channel 126 of the second retention member 110. Accordingly, the retention housing 106 and depth locator 120 may work in cooperation with each other to retain the load transfer members 102, 104 at their proper angle and depth thus indirectly connecting the two load transfer members 102, 104. One of skill in the art will recognize that the retention housing may be constructed of any number of retention members or as a single structure. In addition, the depth locator 120 may be included in the retention housing 106 during the molding process, such that the retention housing 106 forms around it. Each retention member 108, 110 includes a recessed portion 122, 124 designed to accept and guide the load transfer members 102, 104. The depth locator 120 and retention members 108, 110 should be designed such that the cutout portion 164 of the depth locator 120 is located at the intersection of the recessed portions 122, 124 of the retention members 108, 110. As one skilled in the art will appreciate, the exact design of the recessed portions 122, 124 and cutout portion 164 will vary depending on the application, by taking into consideration such factors as the size and shape of the load transfer members 102, 104 and the angle at which the load transfer members 102, 104 will be positioned. Once the depth locator 120 and two retention members 108, 110 are assembled, the two retention members 108, 110 may optionally be connected by a connecting means. In the preferred embodiment, a strip of self-adhesive tape 112 may be applied to the perimeter of the left end 114 and right end 116 of the assembled retention housing 106, as is shown in FIG. 1. However, other connecting means may be used, such as other mechanical connection or chemical bonding.

Next, the load transfer members 102, 104 should be inserted. When constructing a sandwich or double wall panel, it is generally desirable to insert the retention housing 106 with the depth locator 120 inside into the insulation layer of the panel prior to inserting the load transfer members 102, 104. In the preferred embodiment, the anchoring means 118 face outward from the device 100. Referring to FIG. 1, the retention member 110 that is associated with the front surface 101 of the device 100 accepts a load transfer member 104 whose anchoring means 118 faces in the same direction as the front surface 101. The retention member 108 that is associated with the back surface 103 of the device 100 accepts a load transfer member 102 whose anchoring means 118 face in the same direction as the back surface 103. The load transfer members 102, 104 are inserted through the top end 142 of the retention members 108, 110 until the indentations 132 click into place with the appropriate tabs 128 or 130 of the depth locator 120. It is contemplated that the load transfer members 102, 104 may be used alone, with the depth locator 120, with the retention housing 106, or with both the depth locator 120 and retention housing 106. It will be appreciated by one skilled in the art that the length of the load transfer members 102, 104, the angle at which the two load transfer members 102, 104 are positioned, and the configuration of the components of the device 100 are adjustable and can be varied to fit the selected application. Further, the load transfer device 100 of the present invention may be used alone or in combination with other known connectors and load transfer devices. It will be appreciated that the load transfer device 100 may be shipped to a job site either assembled, partially assembled, or unassembled as the situation requires. Additionally, it is contemplated that the components of the load transfer device 100 may be ordered separately or as a set. When all components of the load transfer device 100 are shipped together, the unassembled components can be stacked neatly and compactly in a box, thus reducing shipping costs.

Flexural loads applied to a wall panel are internally resisted by shear in the connector. Similarly, the self-weight of the exterior layer is resisted by shear in the connector. The present invention has a greater shear capacity than connectors of the prior art. Fiber reinforced polymer is stronger in tension than shear. In addition, by placing the load transfer members at an angle, the load transfer device of the present invention resists force due to flexural load and self-weight in tension and thus has a larger capacity. In addition to the increased shear capacity, the load transfer device of the present invention provides many other advantages over the prior art. First, no large voids are left in the insulation layer for placement of the connector that need to be filled by spray foam or another insulation. Because the present connector includes discrete load transfer members, the load transfer members can be strategically placed where the most resistance is required. Further, by using the depth locator, embedment is more accurate during construction. There is no need to tie the load transfer device to the longitudinal steel as required in the prior art. Moreover, the load transfer device can be placed anywhere in the panel as compared to prior art connectors, which must be placed between two insulating sheets.

Figure 13:
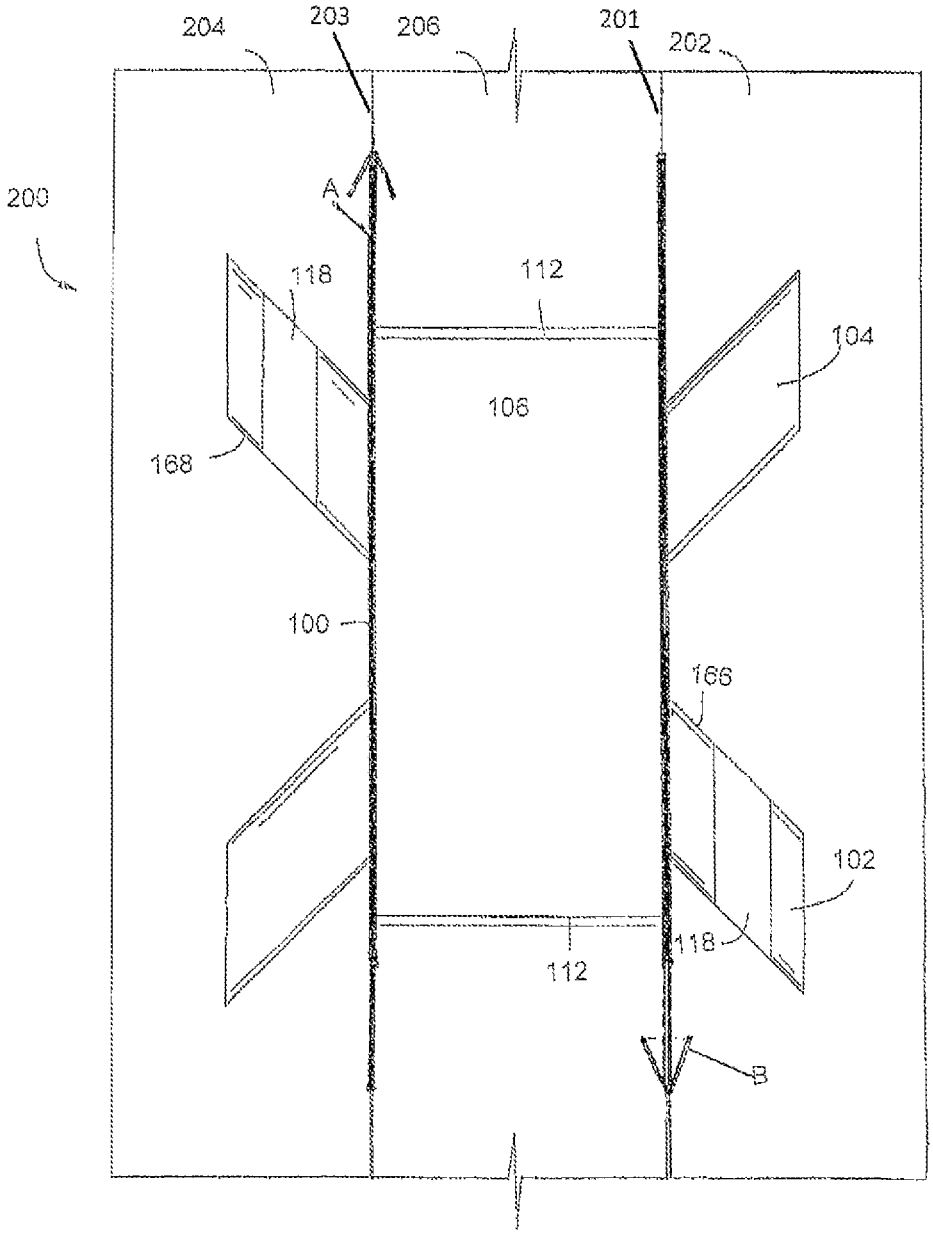
FIG. 13 is a side elevation view of a section of a sandwich panel according to one embodiment of a sandwich panel of the present invention.

The present invention may be used to connect and transfer loads between a variety of components. In one embodiment, the load transfer device 100 may be used with a sandwich wall panel 200, also called an integrally insulated concrete panel. An exemplary sandwich wall panel is shown in FIG. 13. Generally, three layers are present, a first concrete layer 202, a second concrete layer 204, and an insulation layer 206. The first concrete layer 202 includes a first surface 201 that is closest to the second concrete layer 204. In addition, the second concrete layer 204 also includes a first surface 203 that is closest to the first concrete layer 202. Although not shown, the sandwich wall panel 200 may further include an exterior facade attached to the exterior layer of concrete. The sandwich panel 200 includes at least one load transfer device 100 to connect the first concrete layer 202, second concrete layer 204, and insulation layer 206, as is illustrated in FIG. 13. Furthermore, FIG. 13 includes two arrows, A and B, which represent the shear force in the wall panel while in its service position. Generally, the load transfer device 100 of the illustrated embodiment is placed in the wall vertically. At minimum, the load transfer device 100 includes two load transfer members 102, 104. Although one skilled in the art will recognize that any material may be used, in the preferred embodiment the load transfer members 102, 104 are made of fiber reinforced polymer material, which advantageously expands and contracts at the same rate as concrete when exposed to different temperatures and is not as thermally conductive as other materials, such as metal. In the preferred embodiment, the load transfer device 100 further includes a retention housing 106 made of rigid insulation material. Although not shown in the view of FIG. 13, in the preferred embodiment, the retention housing 106 is made of two retention members. The retention members may optionally include recessed portions 122, 124 disposed to accept and guide the load transfer members 102, 104 into place during assembly. The load transfer members 102, 104 may optionally include one or more anchoring means 118. The length of the load transfer members 102, 104 and the angle at which they are positioned are precise, but adjustable and depend on the application and other factors, including but not limited to the thicknesses of the first concrete layer 202, the second concrete layer 204, and the insulation layer 206. The insulation layer 206 may be made of any insulation, as the application requires, but is most often a rigid insulation. Preferred embodiments include expanded or extruded polystyrene or polyisocyanurate, although many types of insulation are known in the art. The insulation layer is disposed to receive at least one load transfer device 100. The present sandwich panel does not depend on insulation bonding with the concrete wythes for strength and load transferring. Rather, the load transfer device 100 is able to transfer the entire loads associated with the sandwich panel 200.

Figure 14:
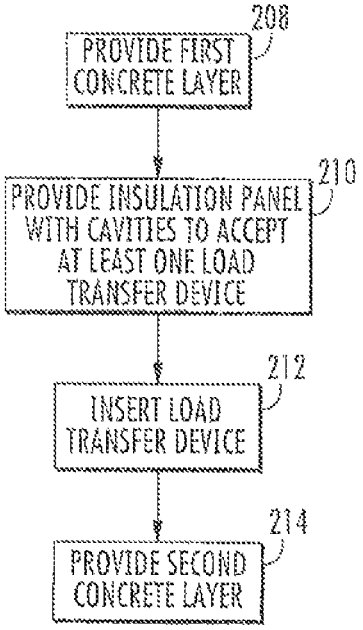
FIG. 14 is a flow chart describing a method for manufacturing a sandwich panel in accordance with the present invention.

The present invention includes methods for manufacturing a sandwich wall panel 200 employing a load transfer device 100, which is described in the flow chart of FIG. 14. The methods can be used with a variety of construction techniques known now or in the future, including but not limited to site-cast tilt-up, plant precast, cast-in-place, and modular precast. As is known in the art, site-cast tilt-up panels are produced horizontally at the job-site, usually using the building floor slab as the primary casting surface. Once the panels are assembled and have cured, the panels are lifted into place to form the building envelope. Precast concrete panels are cast horizontally into shape at a location other than the job-site. Once the panels are assembled and have cured, the panels are transported to the job-site for construction. The precast concrete panels of the present invention may be prestressed. Similar to the site-cast tilt-up method, cast-in-place sandwich panels are manufactured at the job site. Cast-in-place wall panels are manufactured vertically and in place at their final location.

Figure 15:
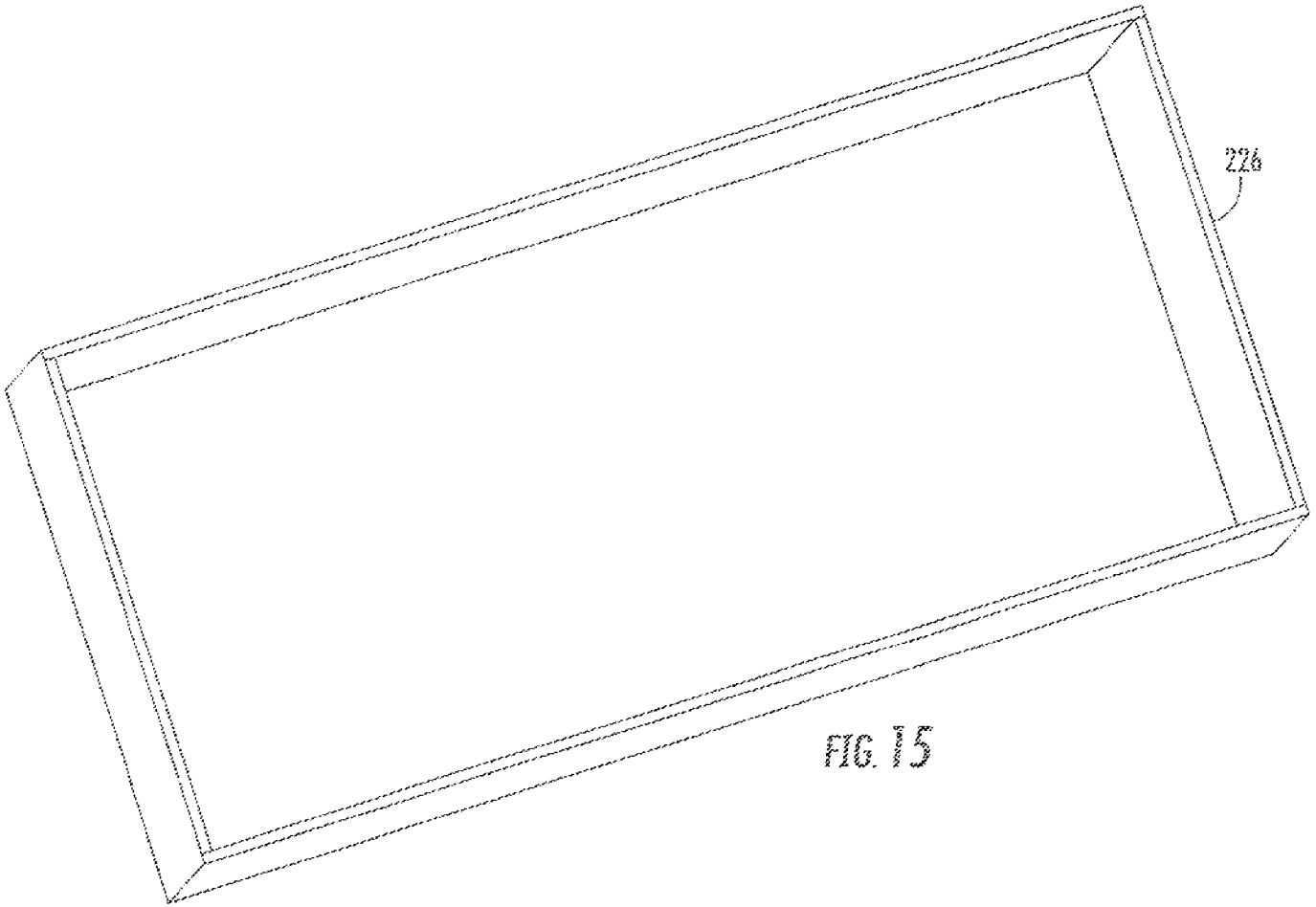
FIG. 15 is an illustration of a form assembly used in the method for manufacturing a sandwich wall panel or a double wall panel in accordance with the present invention.
Figure 16:
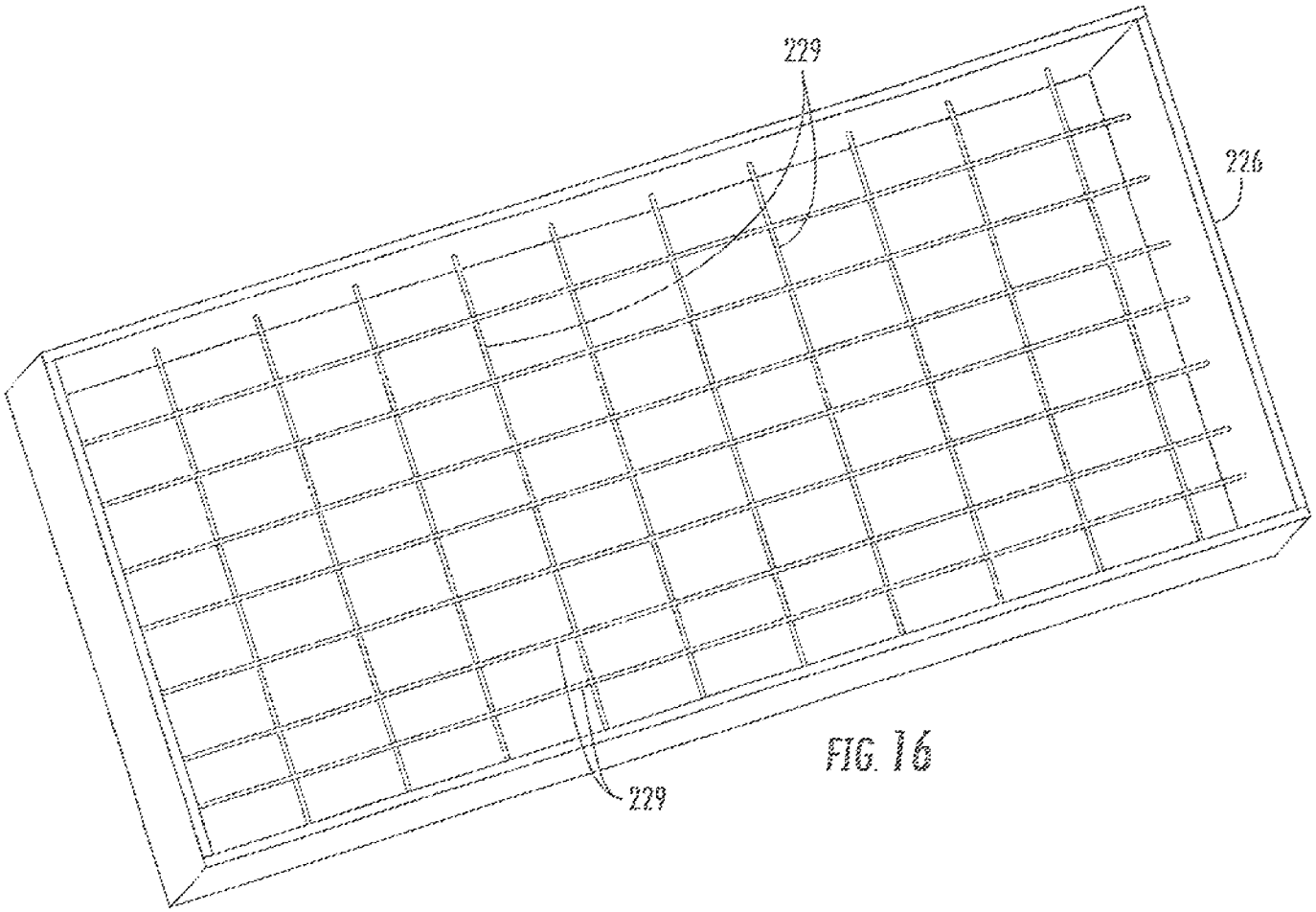
FIG. 16 is an illustration of the form assembly used in the method for manufacturing a sandwich wall panel or a double wall panel further showing reinforcing in accordance with the present invention.
Figure 17:
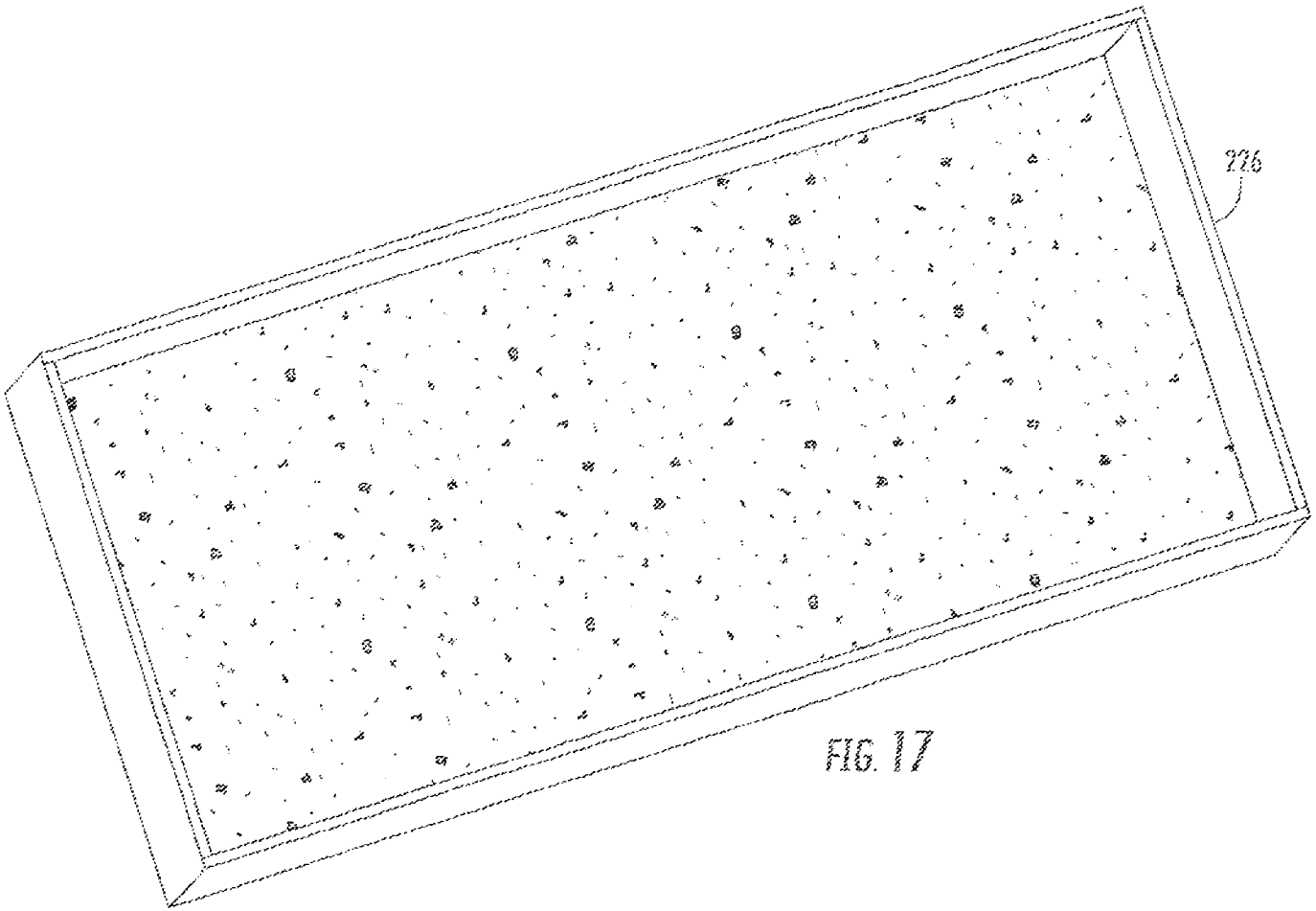
FIG. 17 is an illustration of the form assembly used in the method for manufacturing a sandwich wall panel or a double wall panel, wherein a first layer of concrete has been placed in the form assembly in accordance with the present invention.

Referring to FIG. 14, a method for manufacturing a sandwich wall panel generally begins by providing a first concrete layer, as is shown by block 208. As illustrated in FIG. 15, the concrete may be poured into a mold or form 226 for plant precast methods to make sections of sandwich panel 200 which will then be shipped to a job site. Alternatively, the first concrete layer 202 may be poured into a large mold as part of a site-cast tilt-up method with cutouts such as windows and doors included in the mold. As shown in FIG. 16, the form 220 may include reinforcing 220 placed into the mold before the concrete is poured into the form 226. Alternatively, the reinforcing may be pushed into the wet concrete after it has been poured into the form 226. As discussed above, the reinforcing is optional. The form 226 is then filled with wet concrete, as shown in FIG. 17.

Figure 18:
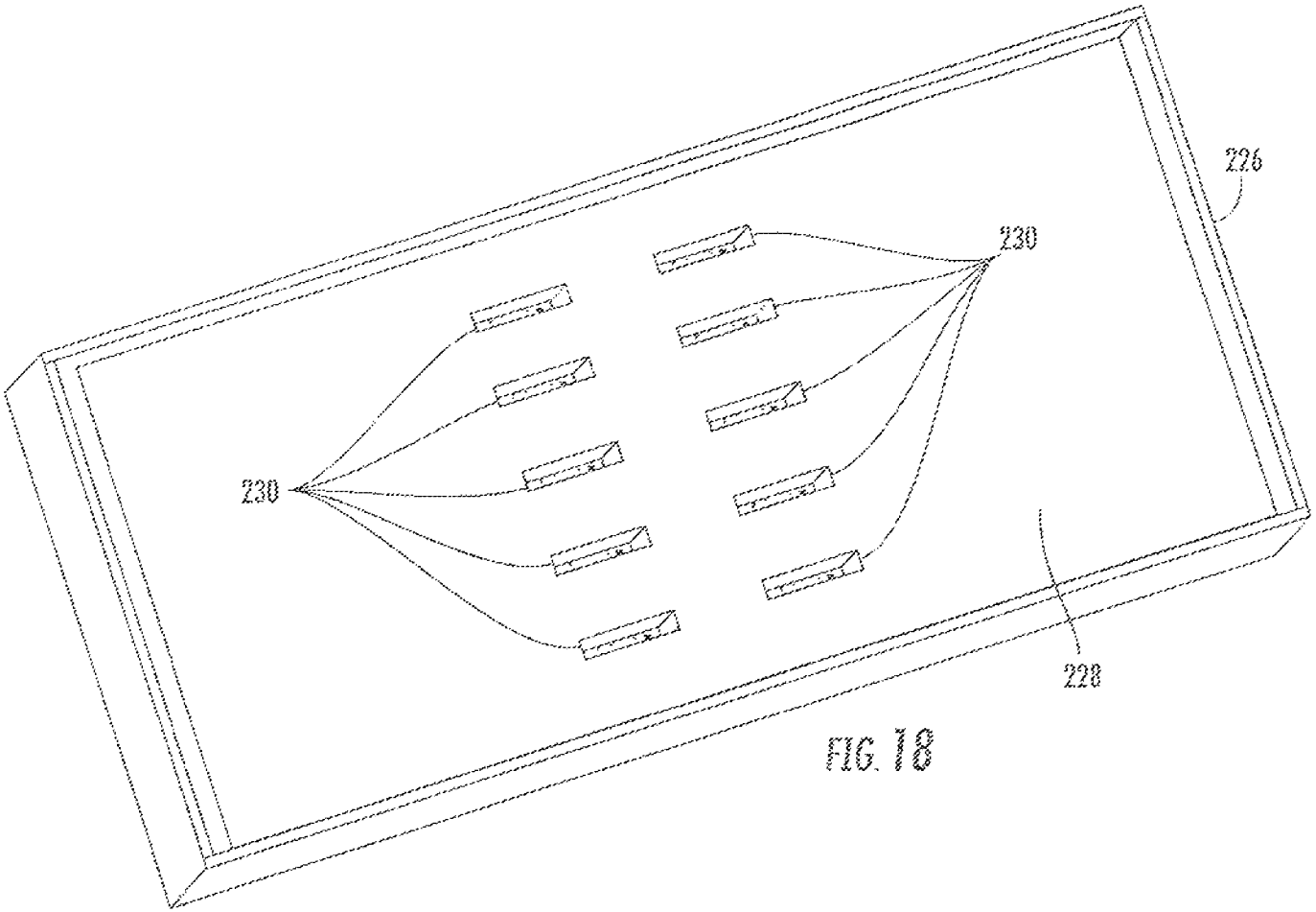
FIG. 18 is an illustration of the form assembly used in the method for manufacturing a sandwich wall panel or a double wall panel, wherein an insulating panel has been added to the first concrete layer in accordance with the present invention.

Next, as provided in FIG. 14 block 210 and illustrated in FIG. 18, an insulation panel 228 is placed on top of the first concrete layer while the concrete is still wet or plastic. Optionally, this is accomplished by providing small sections of insulation in a predetermined pattern. One of skill in the art will recognize that more than one piece and/or layer of insulation may be provided. The insulation panel 228 is disposed to receive at least one load transfer device 100. In the preferred embodiment, this means that, the insulation panel 228 is disposed to receive at least one retention housing 106 of the load transfer device, generally by having cavities 230 at predetermined locations. In addition, the Insulation panel 228 may be disposed to receive one or more connectors of a different type.

Figure 19:
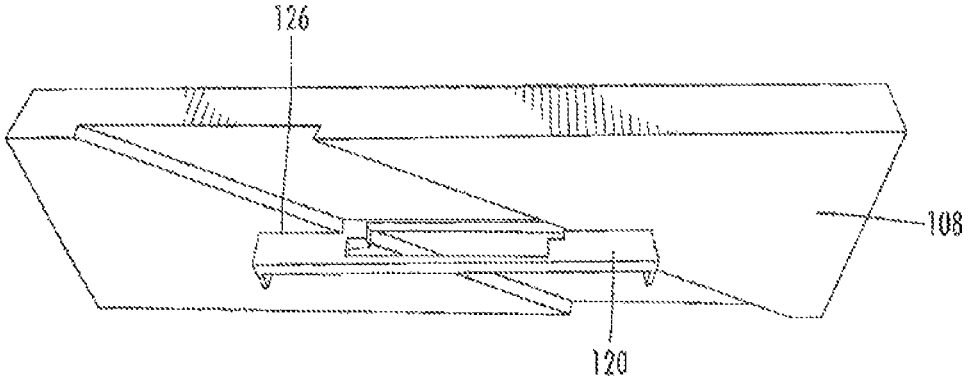
FIG. 19 is an illustration of the load transfer device used in the method for manufacturing a sandwich wall panel or a double wall panel in accordance with the present invention.

Next, referring to block 212 of FIG. 14, at least one load transfer device 100 is inserted into the insulation panel 228 such that the load transfer members 102, 104 are positioned at an angle to the normal of the planes at which the first concrete layer 202 and the insulation panel 228 meet and the second concrete layer 204 and the insulation layer meet. As previously discussed, the load transfer device 100 may be composed solely of the two load transfer members 102, 104. Optionally, the load transfer device 100 may include a depth locator 120, a retention housing 106, or, as in the preferred embodiment, both. When using only the two load transfer members 102, 104, they are inserted through the insulation panel 228 and into the wet concrete. In the preferred embodiment, as illustrated in FIG. 19, the depth locator 120 is inserted into the channel 126 to accept the depth locator 120 of the first insulating retention member 108. The second insulating retention member 110 is then added, such that the channel 126 of the second insulating retention member 110 receives the depth locator 120. Optionally, an adhesive or other connecting means may be used to hold the retention members 108, 110 in place. In the preferred embodiment, a piece of self-adhesive tape 112 is wrapped around the perimeter of the left end 114 and right end 116 of the retention housing, which is illustrated in FIG. 13.

Figure 20:
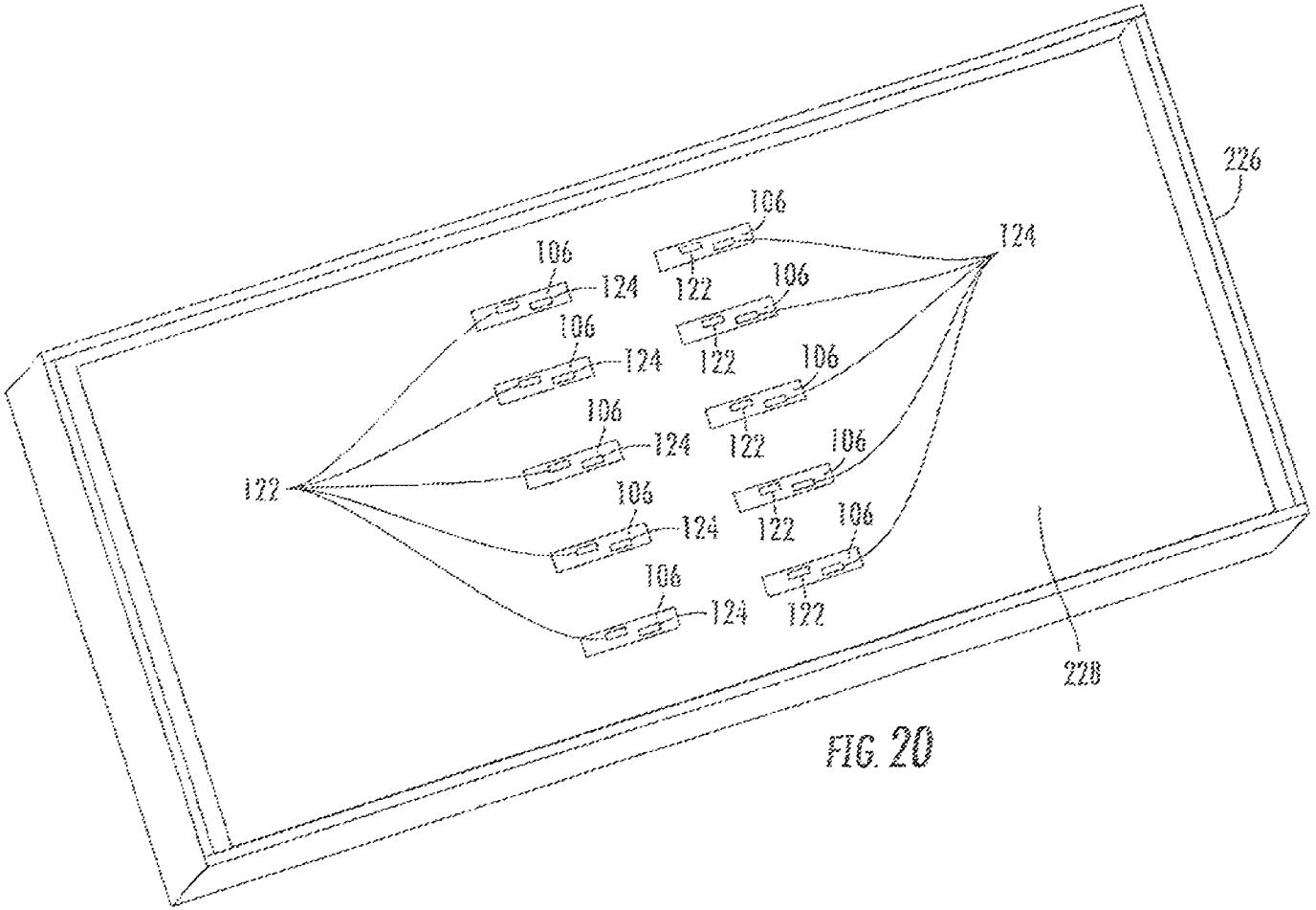
FIG. 20 is an illustration of the method for manufacturing a sandwich wall panel or a double wall panel, wherein retention housings for the load transfer devices have been inserted into the insulating panel in accordance with the present invention.

The assembled depth locator 120 and retention housing 106 are then inserted into the cavities 230 of the insulation panel 228, as is illustrated by FIG. 20. Generally the depth of the retention housing 106 is the same distance as the depth of the insulation layer 206, which for purposes of this illustration is one insulation panel 228. Therefore, the retention housing is flush with the insulation layer 206 where the insulation layer 206 meets the first concrete layer 202 and second concrete layer 204. Accordingly, once the one or more retention housings 106 are inserted into the insulation panel 228, the only voids in the insulation are the recessed portions 122, 124 in the one or more retention housings 106 to accept and guide the load transfer members 102, 104, as is shown in FIG. 20. The ends of the retention housing 106 may taper downward and correspond to a tapering in the cavities 230 of the insulation panel to hold the retention housing 106 in the insulation panel 228. Alternatively, the retention housings 106 may already be inserted into the insulation panel 228 when it is placed on top of the wet concrete.

Next, the load transfer members 102, 104 are inserted, as is shown in FIG. 21. The load transfer members 102, 104 are inserted through the top of the retention housing 106 until the indentation 132 of each load transfer member 102, 104 reaches the appropriate tab 128 or 130 of the depth locator 120, as shown, in FIG. 2. This creates an audible clicking noise. When the indentation 132 snaps into place with the appropriate tab 128 or 130, it also becomes significantly harder to continue to insert the load transfer member 102, 104, thus creating another way for the user to determine that the load transfer member 102, 104 has reached the appropriate depth. As is shown in FIG. 13, the bottom portion 166 of the load transfer member 102, including the optional anchoring means 118, extends into the first concrete layer 202. The second load transfer member 104 is then inserted through the retention housing 106 and into the first concrete layer 202. As is shown in FIGS. 13 and 21, the top portion 168 of both load transfer members 102, 104 extend beyond the insulation panel 228.

Figure 22:
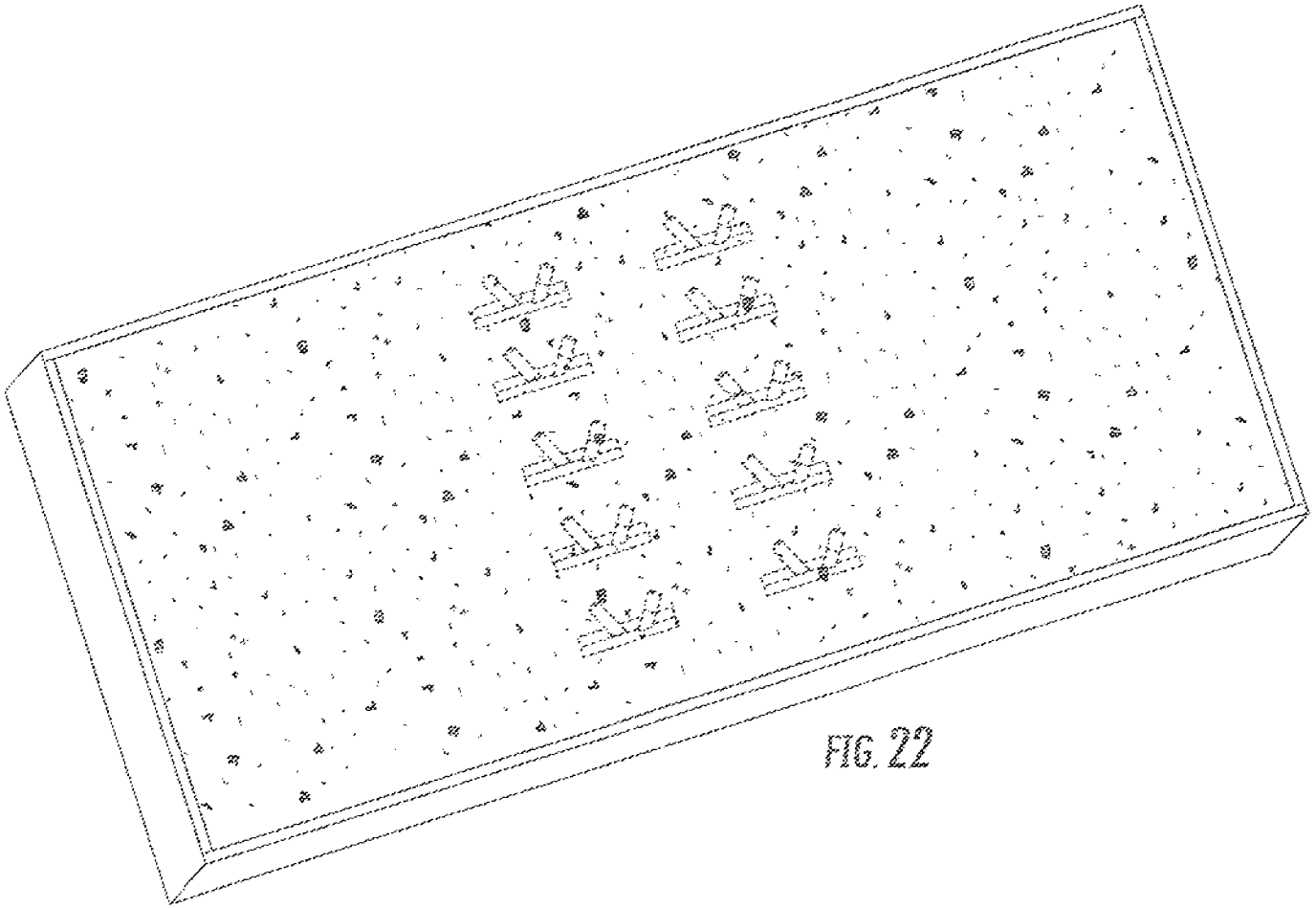
FIG. 22 is an illustration of the method for manufacturing a sandwich wall panel wherein a second concrete layer has been poured, completely surrounding the load transfer devices in accordance with the present invention.

Referring to block 214 of FIG. 14, the second concrete layer 204 is then poured atop the insulation layer, such that it completely surrounds and encloses all parts of the load transfer device 100, as is shown in FIG. 22. The method eliminates any remaining spaces or voids, which decrease thermal efficiency, in the insulation layer 206. Oftentimes, these spaces or voids are present in the sandwich panels of the prior art and require a second application of insulation, such as foam insulation, in the spaces or voids to increase the thermal efficiency of the panel. The present sandwich panel eliminates the need to apply a second form of insulation, thus providing time and cost savings. Once the concrete cures, the sandwich wall panel is complete. It may be removed from the form and used to construct a building or other structure.

Figure 23:
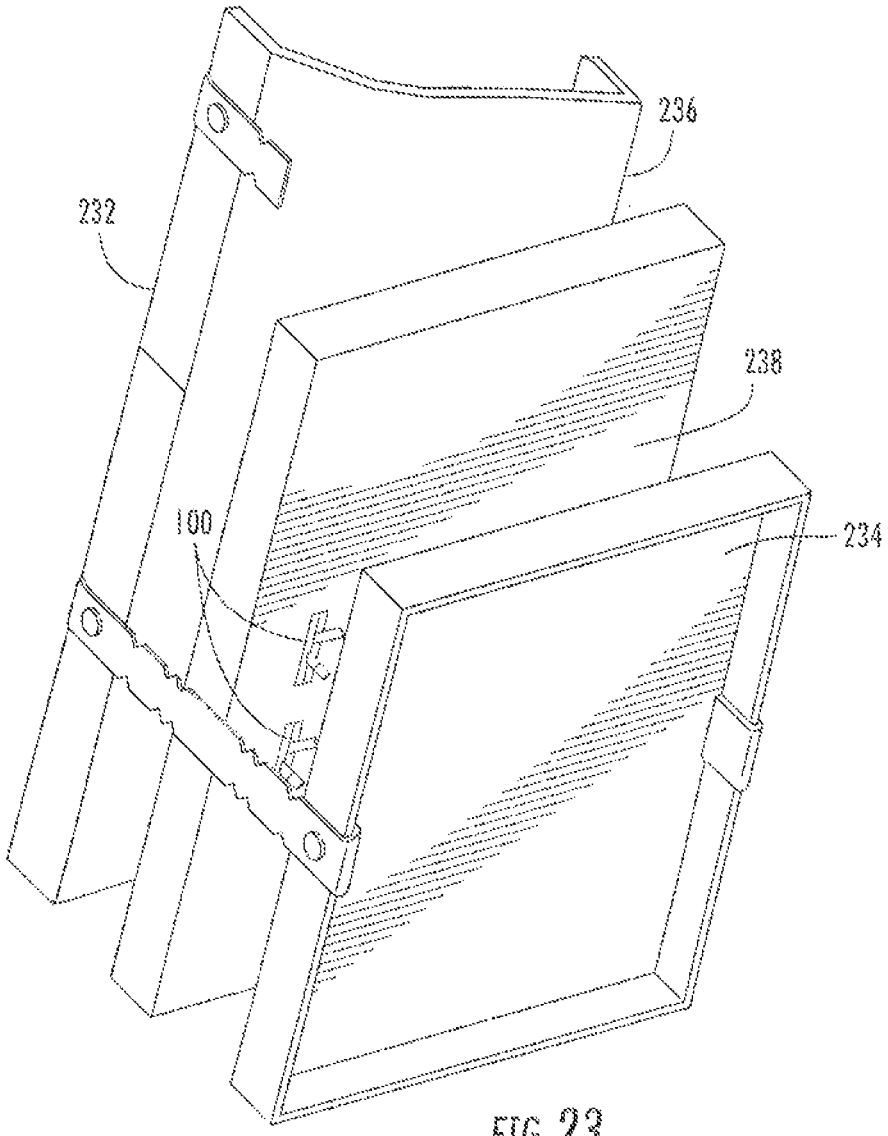
FIG. 23 is a perspective view of a form assembly used in a second method for manufacturing a sandwich wall panel, wherein the sandwich wall panel is cast-in-place in accordance with the present invention.

Alternatively, the sandwich panel 200 may be constructed vertically using a cast-in-place method. To do so, a cast-in-place form 232 is used, as shown in FIG. 23. The cast-in-place form 232 includes an interior form wall 234 and exterior form wall 236, which are erected at the wall's service position. A piece of insulation 238 is then placed between the interior form 234 and exterior form 236. Before the insulation 238 is set into place, one or more load transfer devices 100 are inserted into the insulation 238 at predetermined locations in the manner described above. Concrete is then introduced into the cast-in-place form 232 on both sides of the insulation 238 to create interior and exterior concrete wythes.

Figure 24:
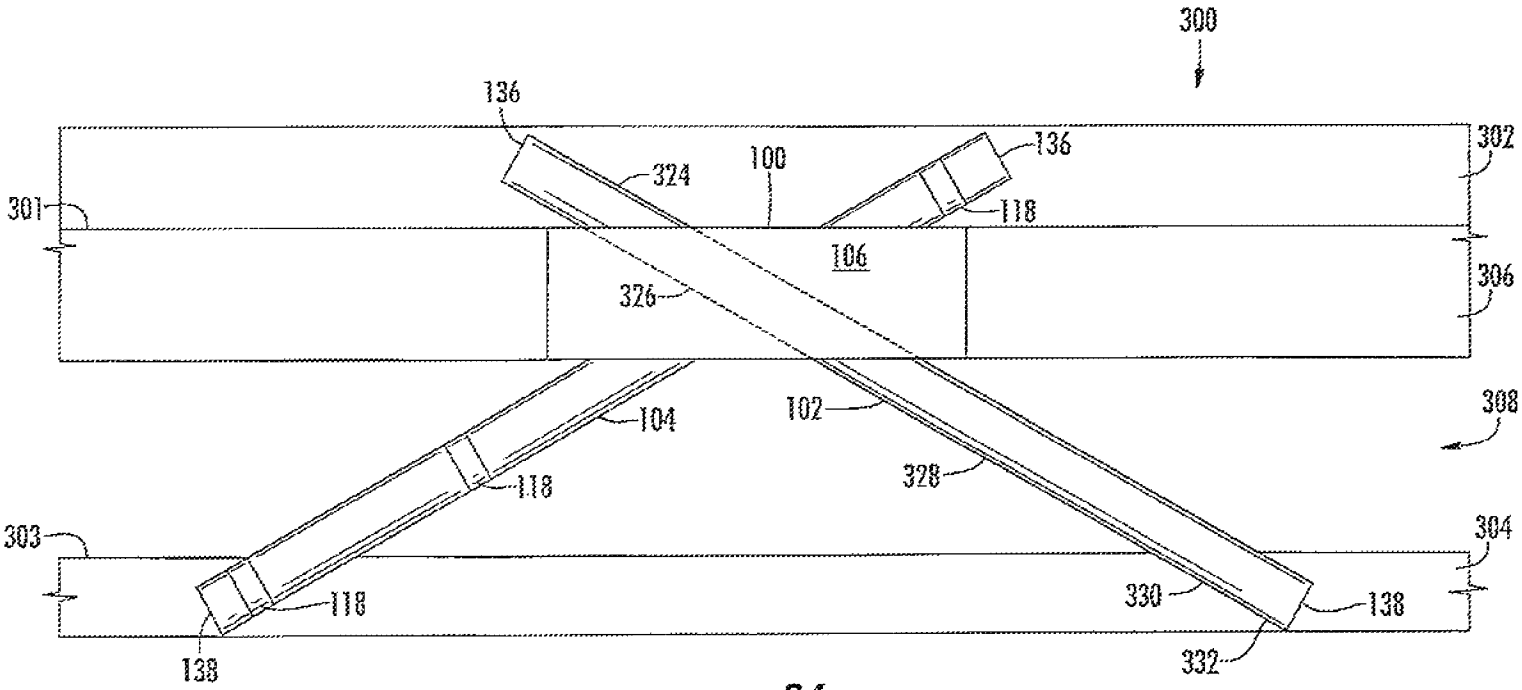
FIG. 24 is a side elevation view of a section of a double wall panel including the load transfer device in accordance with the present invention.

The present invention also includes a double wall panel 300 engaging the disclosed load transfer device 100. Referring to FIG. 24, the double wall panel 300 includes a first concrete layer 302, a second concrete layer 304, an insulation layer 306, and an air void 308. The first concrete layer 302 includes a first surface 301 which is closest to the second concrete layer 304. In addition, the second concrete layer 304 includes a first surface 303, which is closest to the first concrete layer 301. The double wall panel 300 further includes at least one load transfer device 100. In its simplest form, the load transfer device includes two load transfer members 102, 104. Optionally, the load transfer device 100 may further include a depth locator 120 (not shown in FIG. 24), a retention housing 106, or, as in the preferred embodiment, both. The load transfer members 102, 104 may include anchoring means 118. As is shown in FIG. 24, in the preferred embodiment of the double wall configuration, the load transfer member 104 includes three anchoring means 118. The load transfer member 102 also includes three anchoring means 118, which are not shown in this view. If desired, the air void 308 may be filled with another material, such as concrete and/or additional insulation materials, once the double wall panel has been set into place at the construction site. Accordingly, the anchoring means 118 located in the air void 308 provides anchoring with the optional air void material. As can be seen in FIG. 24, the top edges 136 and bottom edges 138 of the two load transfer members 102, 104 are not parallel with the planar surface of the concrete layers 302, 304 or insulation layer 306, as is the case with the preferred embodiment of the sandwich wall panel 200. Rather, the top edges 136 and bottom edges 138 are at an angle to the planar surface of the concrete layers 302, 304 and insulation layer 306. Further, the load transfer device 100 can be a standoff connector, with the lower tip 332 extending to the outside surface of the second concrete layer 304. The load transfer members further include a portion 324 that spans the first concrete layer 302, a portion 326 that spans the insulation layer 306 through the retention housing 106, a portion 328 that spans the air void 308, and a portion 330 mat spans the second concrete layer 304.

Figure 25:
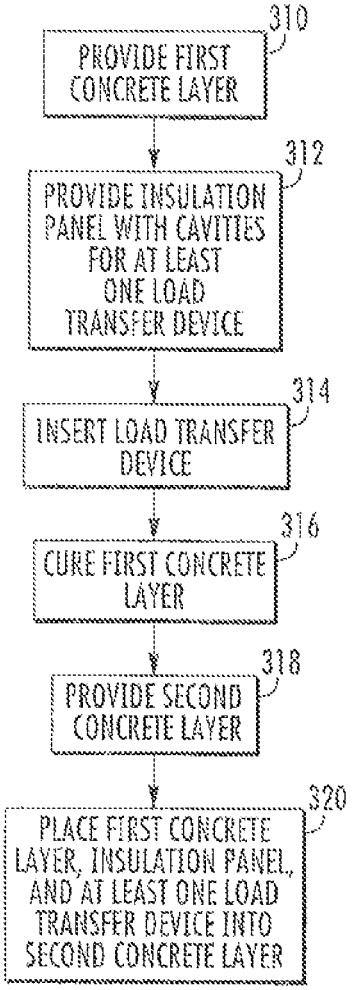
FIG. 25 is a flow chart describing a method for manufacturing a double wall panel in accordance with the present invention.

Also provided in the present invention is a method for manufacturing a double wall panel 300 employing the disclosed load transfer device 100. Referring to FIG. 25, as shown in block 310, the first step in the method for manufacturing a double wall panel is to provide a first concrete layer 302. In horizontal applications, such as the plant precast and site-cast tilt-up methods discussed above, the first concrete layer 302 is generally poured into a form 226, such as a steel pallet in the plant. An exemplary form 226 is provided in FIG. 15. Optionally, reinforcing 229 may be provided in the first concrete layer. The reinforcing 229 may be placed in the form before the wet concrete is added, as shown in FIG. 16, or, alternatively, the reinforcing 229 may be placed in the wet concrete alter it is poured. As illustrated in FIG. 17, wet concrete is then poured into the form 226. Next, referring to block 312, an insulation panel 228 is provided on top of the wet concrete in the form 226, as is shown its FIG. 18. One of skill in the art will recognize that the insulation layer may be provided in multiple panels with one or more pieces and/or layers of insulation provided. Generally, the insulation panel 228 is added while the concrete is still wet or plastic. The insulation panel 228 is disposed to receive at least one load transfer device 100. In the preferred embodiment, this means that the insulation panel 228 is designed with rectangular-shaped cavities 230 to receive at least one retention housing 106, as shown in FIG. 18.

Next, referring to block 314 of FIG. 25, while the concrete is still wet, at least one load transfer device 100 is inserted into the insulation panel 228 and wet concrete, such that the load transfer members 102, 104 are positioned at an angle to the normal of the plane at which the wet concrete and insulation panel 228 meet, as well as the planes at which the insulation panel 228 and air gap 308 will meet and the air gap 308 and second concrete layer will meet. In its simplest form, the load transfer device 100 of the present invention includes two load transfer members 102, 104. The load transfer members 102, 104 are inserted through the rigid insulation, which is designed to accept the load transfer members 102, 104. Generally, the cavities are just large enough to accept and guide the load transfer device 100, whether it is the load transfer members 102, 104 only or the retention housing 106 which will in turn accept the load transfer members 102, 104 and the depth locator 120. In the preferred embodiment, the cavities accept the retention housing 106 of the load transfer device 100.

Optionally, the load transfer device 100 may include a depth locator 120 also. The retention housing 106 and depth locator 120 are assembled prior to insertion into the insulation panel 228. As is shown in FIG. 19, the depth locator 120 is inserted into the channel 126 designed to accept the depth locator 120 of the first retention member 108. The second retention member 110 is then added, such that the depth locator is inserted into its channel 126 to accept the depth locator 120. Optionally, as in the preferred embodiment, the retention members 108, 110 may be held together with an adhesive, or other connecting means. In the preferred embodiment, the retention members 108, 110 are held together by a strip of self-adhesive tape 112 at the left end 114 and right end 116 of the retention housing 106, as illustrated in FIG. 1. The retention housing 106, with the depth locator 120 inside, is then inserted into a cavity 230 of the insulation panel 228. In the preferred embodiment, the retention members 108, 110 include two recessed portions 122, 124 to accept and guide the load transfer members 102, 104, which become the only voids present in the insulation panel 228, as shown in FIG. 20. The first load transfer member 102 is inserted into the retention housing 106 and through the depth locator 120. As discussed above and shown in FIGS. 2 and 12, the depth locator 120 includes a set of slightly flexible tabs 128, 130. The load transfer members 102, 104 each include an indentation 132. The indentation 132 accepts the appropriate tab 128 or 130 of the depth locator. The first load transfer member 102 is inserted until the indentation 132 accepts the appropriate tab 128 or 130. At that point, an audible clicking sound is created. In addition, it becomes more difficult to continue pushing the load transfer member 102 through the depth locator. Accordingly, the user can be sure that the load transfer member 102 is inserted to the appropriate depth for the application. The same process is repeated for the second load transfer member 104 which also includes an indentation 132 that corresponds to a tab 128 or 130.

Figure 26:
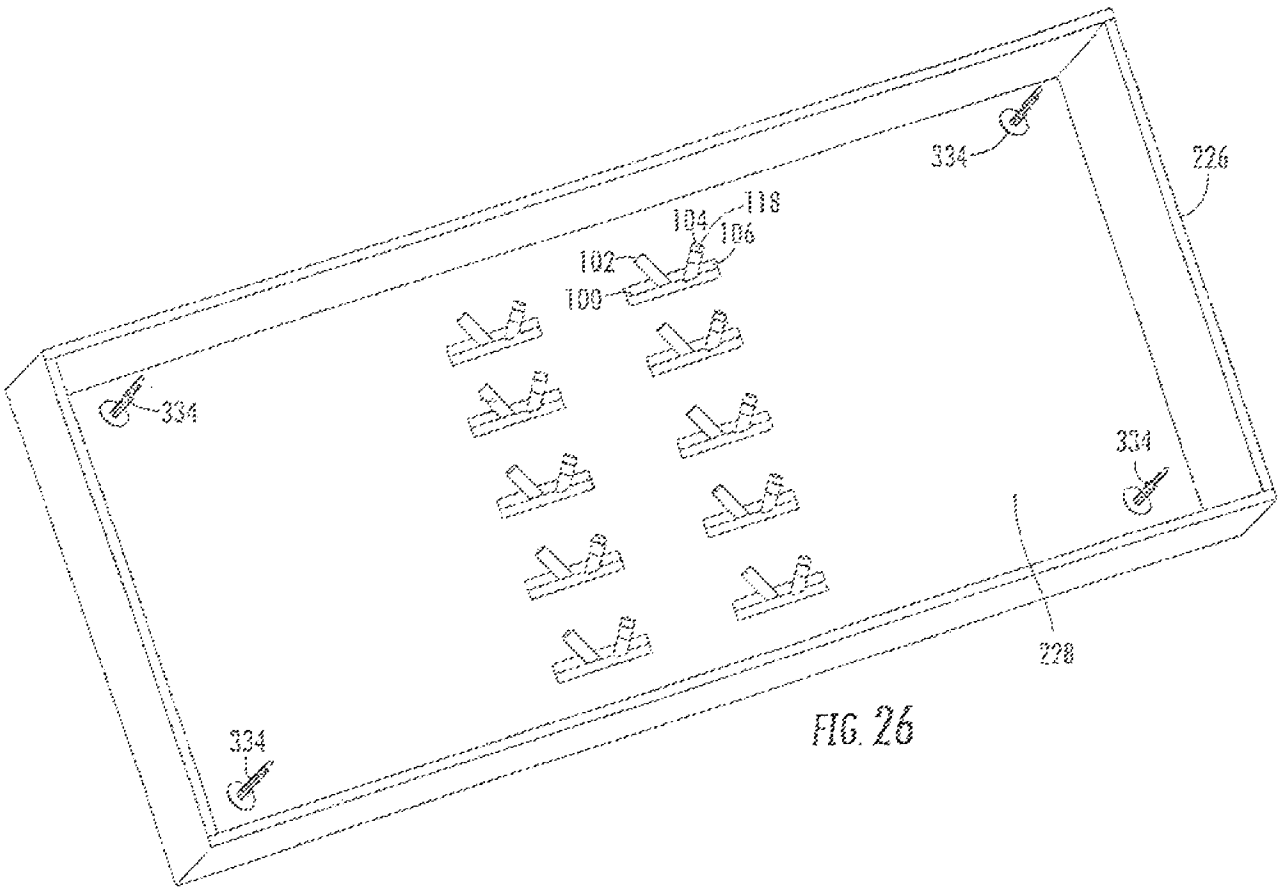
FIG. 26 is an illustration of a form assembly used in a method for manufacturing a double wall panel, further showing one embodiment of the load transfer device which has been inserted along with standoff devices in accordance with the present invention.
Figure 27:
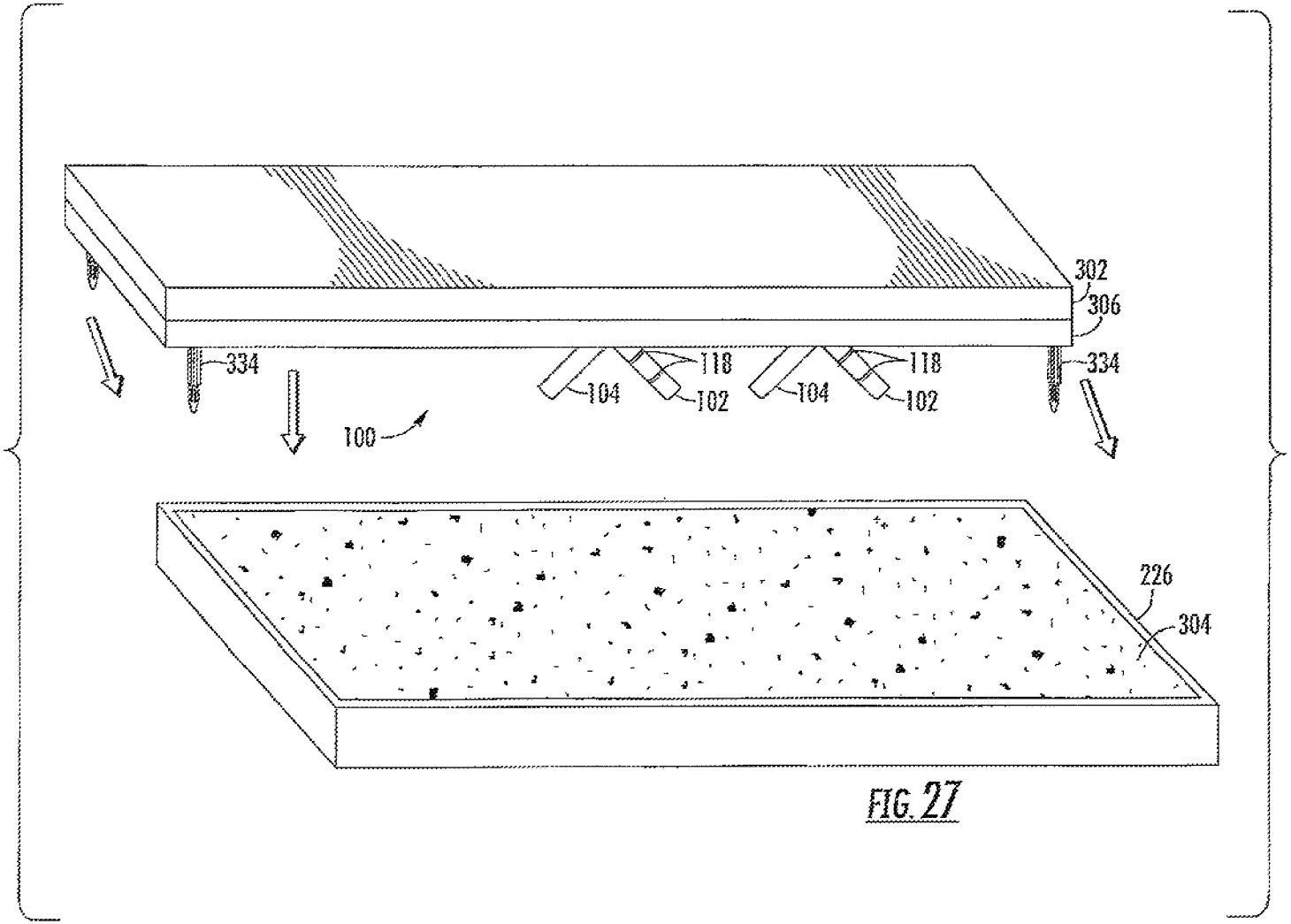

FIG. 26 provides an illustration of the double wall panel 300 at this point. The wet concrete has been poured, and the insulation panel 228 has been provided on top of the wet concrete. The retention housing 106 of the load transfer device 100 has been inserted into the cavities 230 of the insulation panel 228. Further, the load transfer members 102, 104 have been inserted into the retention housing 106, clicking into place with the depth locator 120 (not shown), and with portions 324 extending into the wet concrete. The load transfer members 102, 104 also extend above the retention housing 106 into the air above the wet concrete and insulation panel 228. The anchoring means 118 of load transfer member 104 can be seen.

In addition to the load transfer device 100, other connectors known now or in the future, may also be used to connect the layers of the double wall panel 300 without departing from the scope of the present invention. Referring again to FIG. 26, standoff connectors 334 may be used. The standoff connectors 334 span the entire double wall panel and define its thickness. The standoff connectors 334 are inserted at the same time as the load transfer device 100 and extend all the way to the bottom of the form and accordingly through the entire first concrete layer 302. The standoff connectors 334 further span the insulation layer and extend into the air above the insulation layer. When the second layer of concrete 304 is added, the standoff connector 334 further spans it and hits the bottom of the form, thus defining the thickness of the double wall panel, while leaving a space for the air gap. As will be described below, in the preferred embodiment, the first concrete layer 302, insulation layer 306, load transfer device 100, and any other connectors are lifted, rotated 180° and lowered into the second concrete layer. In this embodiment the standoff connectors 334 hit the bottom of the form and may help support those layers that are suspended above the second concrete layer 304. Alternatively, the second concrete layer 304 may be added above the other layers. Optionally, means may be added to transport the first concrete layer 302, insulation layer 306, load transfer device 100, and optional, standoff connector 334. The standoff connector 334 may further include the means for transporting the first concrete layer 302, insulation layer 306, and load transfer device 100.

After the first concrete layer 302, insulation layer 306, at least one load transfer device 100, and any other connectors, including standoff connectors 334, and transporting means are added, the concrete of the first concrete layer 302 is allowed to cure, as shown by block 316 of FIG. 25. In the preferred embodiment, the panel thus far is moved to an oven or steam chamber for curing. Alternatively, the panel may be left at room temperature for a prescribed period of time, such as twenty four (24) hours. Once the first concrete layer 302 has cured, the first concrete layer 302, insulation layer 306, load transfer device 100, and any other connectors such as standoff connectors 334 are one unit and may be moved or transported as such. Accordingly, the double wall panel 300 in progress may be transported, and the panel need not be finished in the same location as where it was started. For example, the double wall panel 300 in progress may be transported to the job-site for the remaining steps. In the alternative, the remaining steps may take place in a plant.

Figure 27:
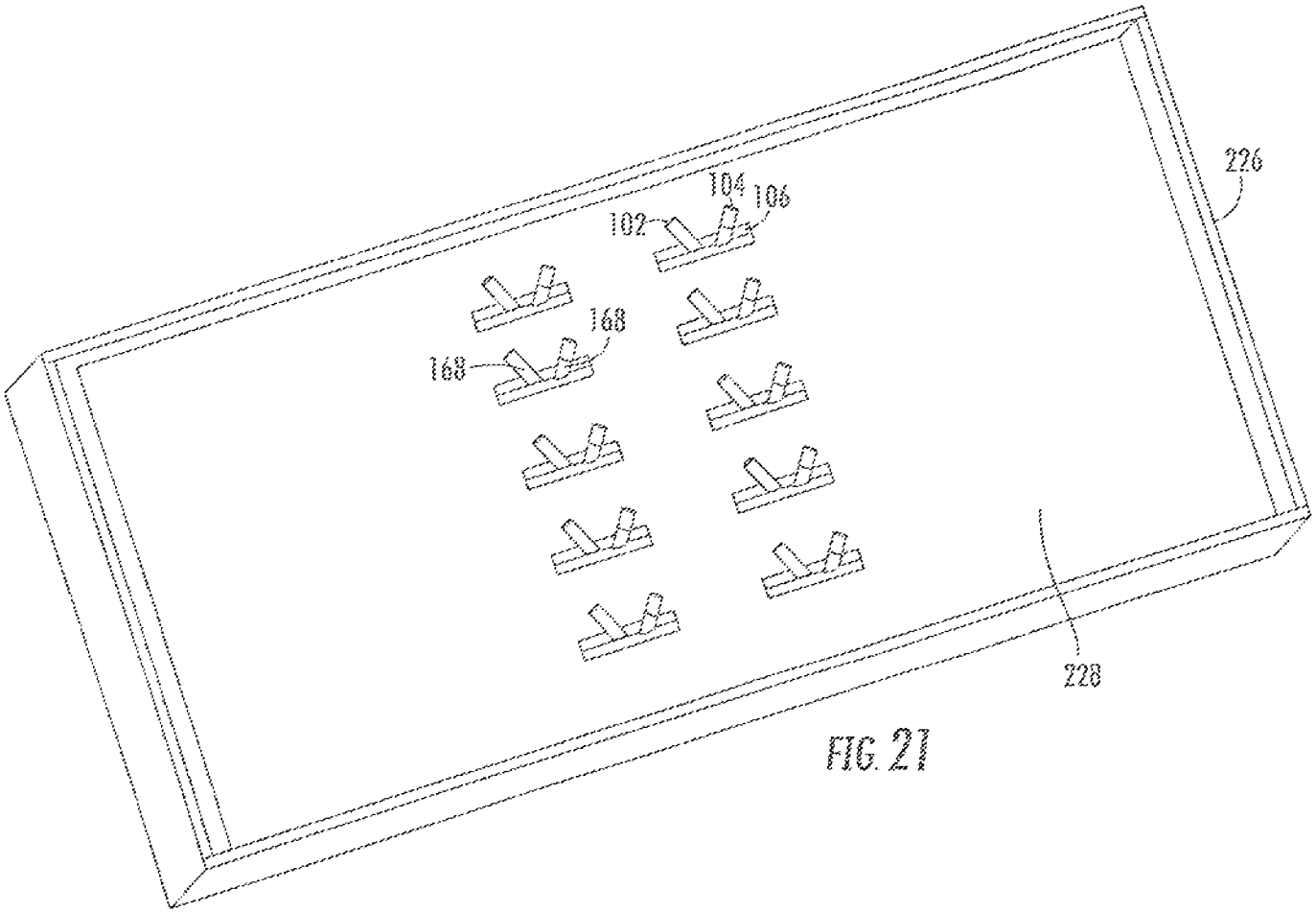
FIG. 27 is an illustration of the form assembly used in the method for manufacturing a double wall panel, wherein a second concrete layer has been provided, and the first concrete layer, insulation panel, load transfer devices, and standoff devices are rotated 180° and lowered into the second concrete layer in accordance with the present invention.

The next step is providing a second layer of concrete 304, as shown by block 318 of FIG. 25. In methods where the double wall panel is manufactured horizontally, the second concrete layer 304 may be added on top of the existing panel. Alternatively, referring to block 320 of FIG. 25, as in the preferred embodiment, the double wall panel in progress, including the first concrete layer 302, insulation layer 306, at least one load transfer device 100, and any other connectors, including standoff connectors 334, and transporting means, are lifted, rotated 180°, and lowered into the second concrete layer 304, which is still wet or plastic concrete that has been poured into a form 226, as shown by FIG. 27. In this embodiment, the second concrete layer 304 may be provided with optional reinforcing. The reinforcing may be present in the form when the concrete is poured, or may be lowered into the concrete alter it has been poured. At this point, the top layers, the first concrete layer 302, insulation layer 306, at least one load transfer device 100, and any other connectors, including standoff connectors 334, and transporting means, may be mechanically held in place, such as by a steel suspension apparatus. Alternatively, the load transfer device(s) 100 in combination with one or more standoff connectors 334 may provide means for supporting the top layers above the air void 308. Finally, the load transfer device 100 may support the layers above the air void 308 without assistance from other means. The second concrete layer 304 is then allowed to cure, either in a steam chamber or oven, or at room temperature for a prescribed period of time.

At this point, the double wall panel is complete. It may be removed from the form and used to construct a building or other structure. If the double wall panel 300 was manufactured, in whole or in part, horizontally at the job-site, the double wall panel 300 will then be tilt-up into the appropriate position. If the double wall panel 300 was wholly manufactured by plant precast methods, the double wall panel will then be shipped to a job-site. Oftentimes, double wall panels 300 are lighter than sandwich panels of the same area. Accordingly, double wall panels 300 manufactured using the plant precast method may be shipped its larger sections than sandwich panels 200. Once in place at the job site, the double wall panel 300 air void 308 may be filled with another material, such as concrete and/or additional insulation materials.

Generally, the sandwich panel 200 and double wall panel 300 will include more than one load transfer device 100 and other connectors known now or in the future. The number of load transfer devices 100 and other connectors will vary depending on the application, and can be designed using methods known now or later developed. FIGS. 28A-31B provide examples of embodiments of panels of the present invention engaging at least one load transfer device 100. Although FIGS. 28A-31B are directed to sandwich panels 200 of the present invention, one skilled in the art will recognize that the configurations may be used to manufacture double wall panels 300 of the present invention.

Figure 28A:
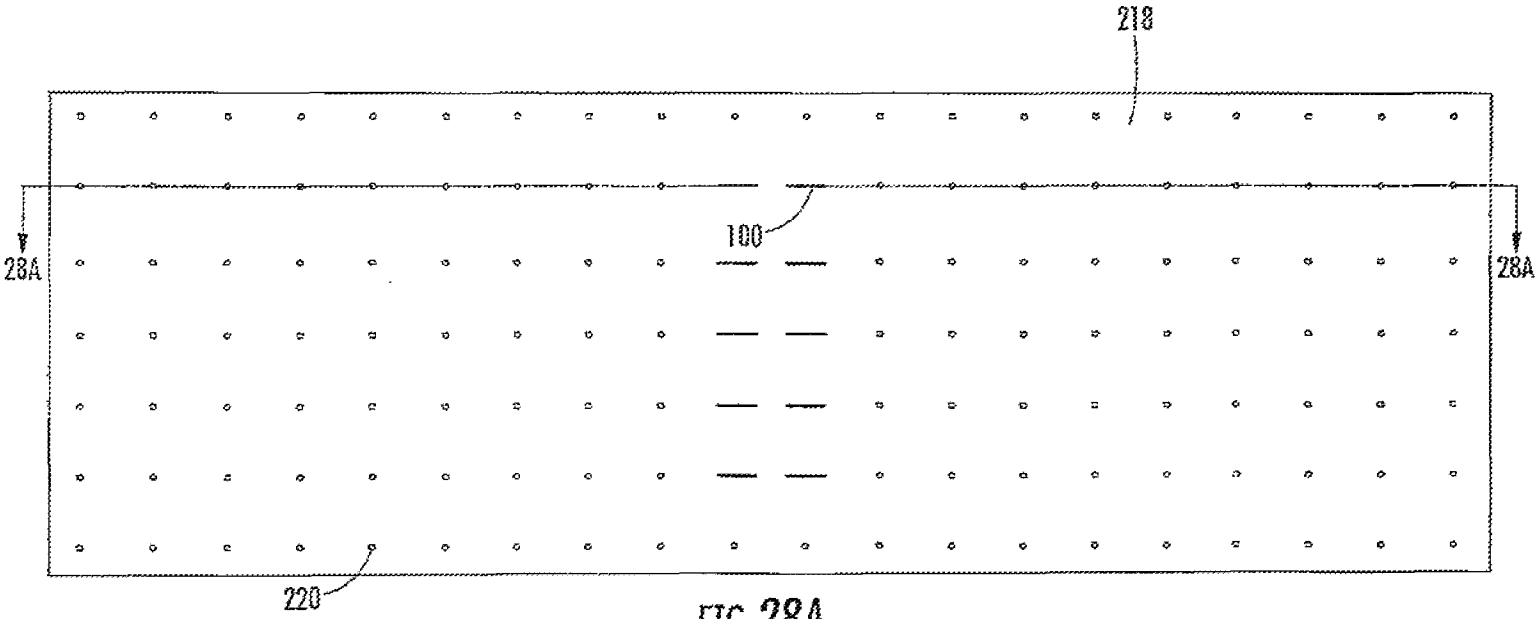
FIG. 28A is a front elevation view of a non-composite vertical sandwich panel in accordance with the present invention.
Figure 28B:
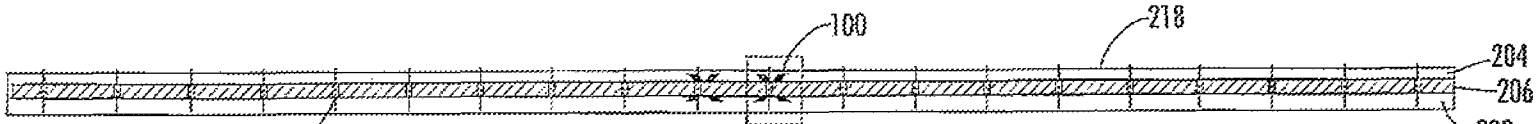
FIG. 28B is a cross-sectional view of the non-composite vertical sandwich panel of FIG. 28A taken along lines 28A-28A.

FIG. 28A provides an embodiment of a non-composite vertical sandwich panel 218, while FIG. 28B provides a cross-sectional view of the panel illustrated in FIG. 28A. As is known in the art, in a non-composite sandwich panel, the layers of the panel, although connected, work independently of each other. The non-composite vertical sandwich panel 218 is connected using ten load transfer devices 100 and one hundred thirty other connectors 220. The load transfer devices 100 are represented by dashes (-), and the other connectors 220 are represented by dots (.). It can be desirable to employ the load transfer device 100 and other connectors 220 in combination, because the practice can provide cost savings. The load transfer device 100 provides significantly higher load transfer properties than other connectors 220; however, the other connectors 220 are smaller, and therefore provide cost savings in manufacturing and shipping compared to the load transfer device 100. Accordingly, one skilled in the art will be able to design panels using both types of connectors by considering the loads required for the application and the cost of each type of connector. In the illustrated embodiment there are two rows of five load transfer devices 100 in the middle of the panel 218. The remaining area of the panel is connected using other connectors 220. The other connectors 220 are used around the entire perimeter of the panel 218.

Figure 29:
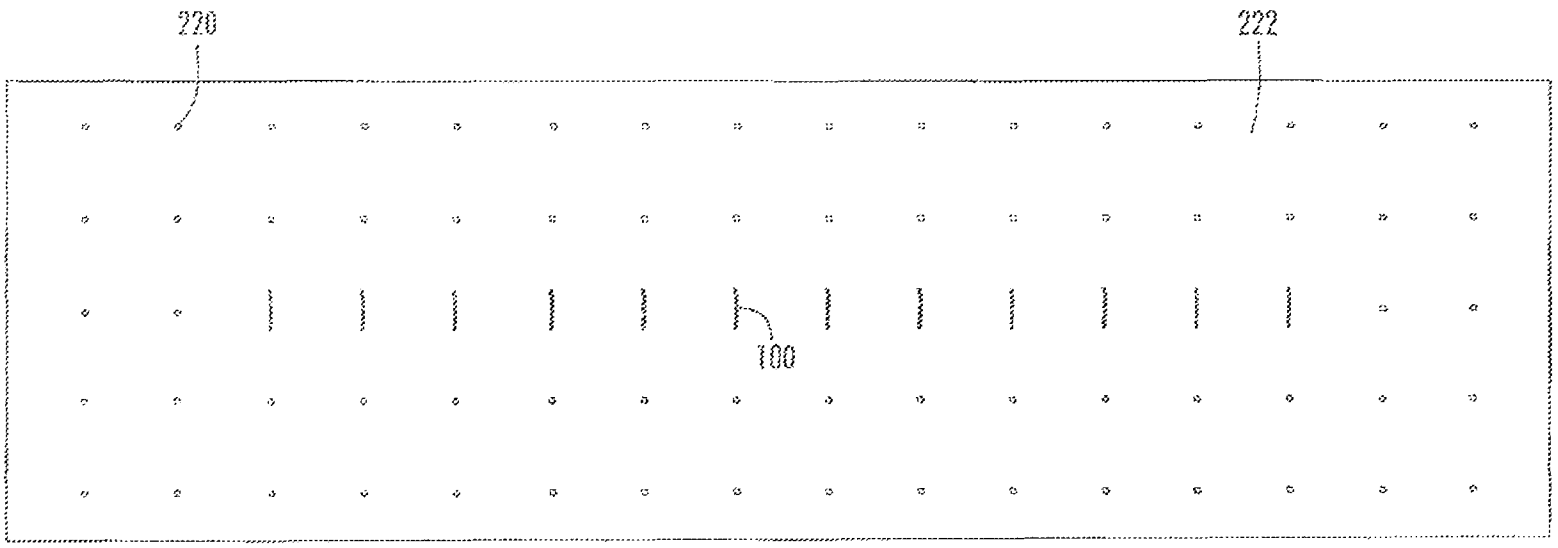
FIG. 29 is a from elevation view of a non-composite horizontal sandwich panel in accordance with the present invention.

FIG. 29 provides an embodiment of a non-composite horizontal panel 222. The load transfer devices 100 are provided in one horizontal row. The other connectors 220 are provided at regular intervals in the remaining area of the panel, including around the entire perimeter.

Figure 30A:
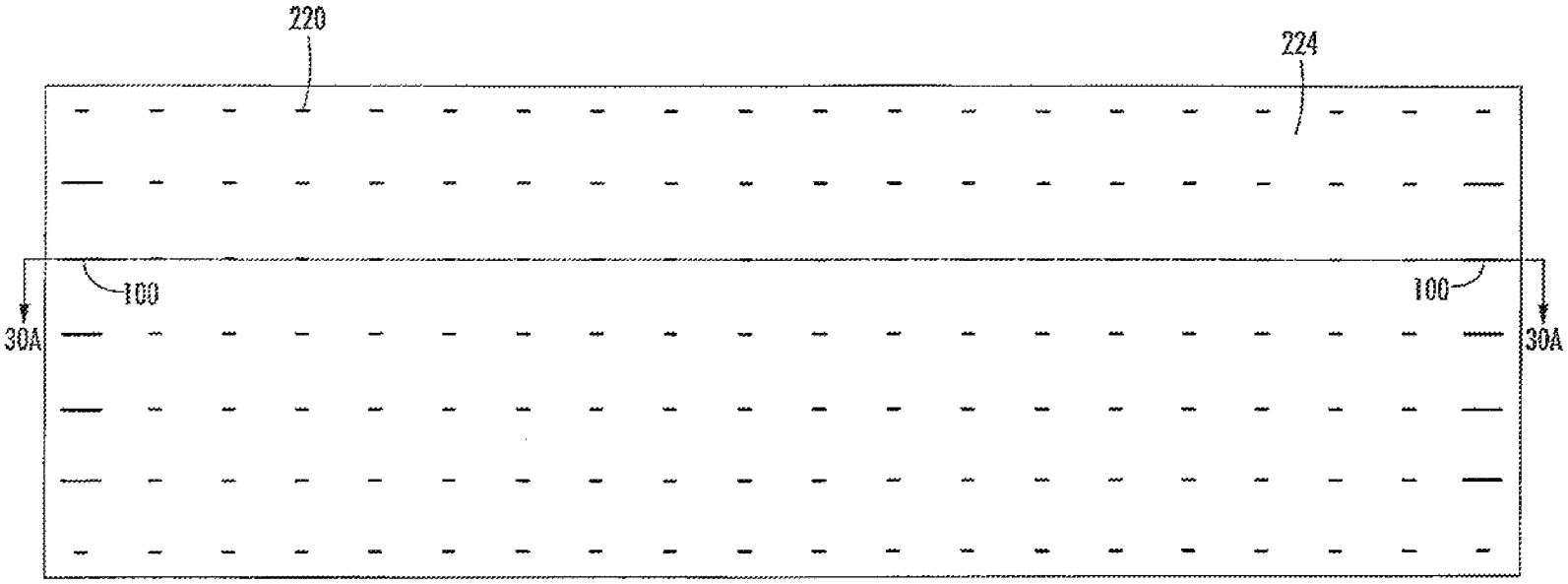
FIG. 30A is a front elevation view of a partial composite vertical sandwich panel in accordance with the present invention.
Figure 30B:
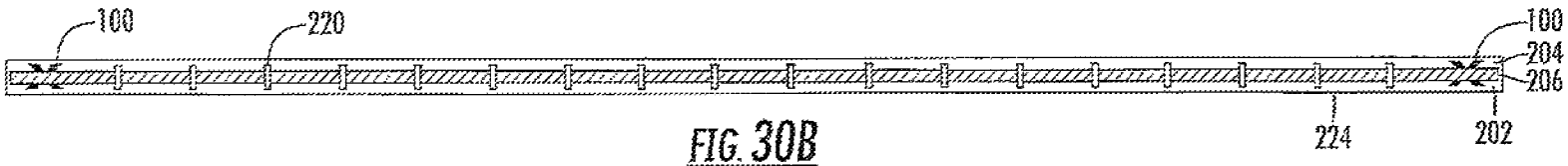
FIG. 30B is a cross-sectional view of the partial composite vertical sandwich panel of FIG. 30A taken along lines 30A-30A.

FIG. 30A provides an embodiment of a partially composite vertical panel 224 while FIG. 30B provides a cross-sectional view of the panel illustrated in FIG. 30A. As is known in the art, a partially composite sandwich panel combines the properties of a non-composite panel, wherein the layers of the panel work independently of each other, and a composite sandwich panel, wherein the layers work in unison. The illustrated partially composite vertical panel 224 includes ten load transfer devices 100 and one hundred thirty other connectors 220. In FIG. 30A, the load transfer devices 100 are represented by long horizontal lines, and the other connectors 220 are represented by shorter horizontal lines. In this illustration, the load transfer devices 100 are present in two rows of five. One row is at the top of the panel 224, and the second row is at the bottom of the panel 224. The other connectors 220 are present in the middle of the panel 224 and in the corners of the panel 224.

Figure 31A:
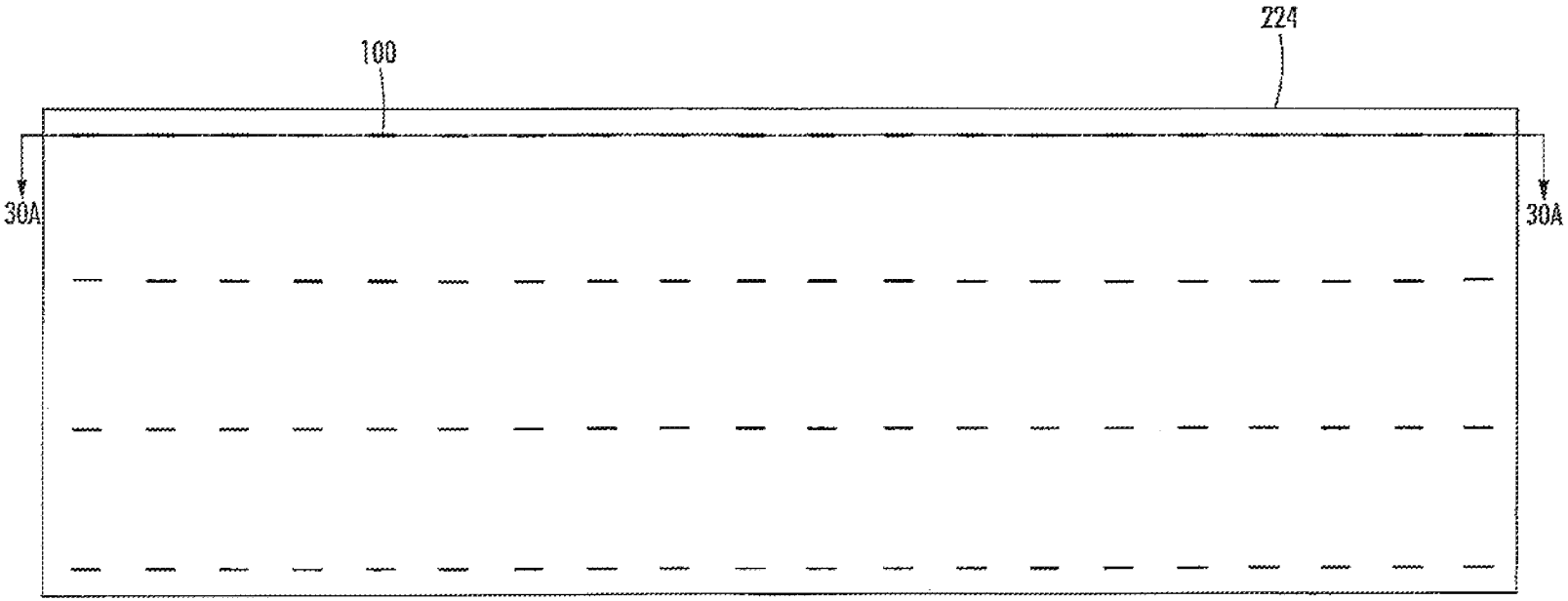
FIG. 31A is a front elevation view of a partial composite vertical sandwich panel in accordance with the present invention.
Figure 31B:
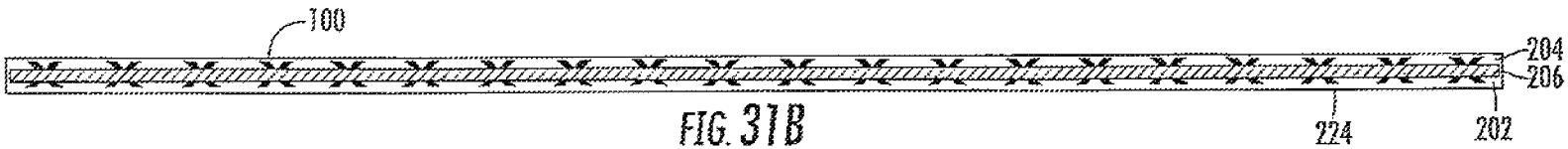
FIG. 31B is a cross-sectional view of the partial composite vertical sandwich panel of FIG. 31A taken along the lines 31A-31A.

FIG. 31A provides a second embodiment of a partially composite vertical panel 224, while FIG. 31B provides a cross-sectional view of the panel illustrated in FIG. 31A. In this embodiment, only load transfer devices 100 are employed. Because the load transfer device 100 has a higher capacity to transfer loads than other connectors, this embodiment is advantageous in applications where more shear transfer is needed due to prominent vertical loading and excessive wind or seismic loads, such as in the case of a tornado shelter. The partially composite vertical panel 224 of FIG. 31A includes eighty load transfer devices 100, arranged in four vertical rows of twenty.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. attached, adhered) are to be construed broadly and may include intermediate members between a connection of elements and relative movement between elements. As such, joinder references do not necessarily infer that two elements are directly connected and in fixed relation to each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace ail known or earlier developed alternatives, modifications, variations, improvements, and/or substantial equivalents.

The invention claimed is:

1. A load transfer device connecting at least first and second concrete elements comprising:

said first concrete element having a first surface closest to said second concrete element;

said second concrete element having a first surface closest to said first concrete element;

a first load transfer member having a first end and a second end, said first load transfer member only in contact with said first and second concrete elements at said first and second ends respectively;

a second load transfer member having a first end and a second end, said second load transfer member only in contact with said first and second concrete elements at said first and second ends respectively;

wherein said first load transfer member and said second load transfer member are positioned at an angle to the normal of said first surface of said first concrete element and at an angle to the normal of said first surface of said second concrete element;

wherein said first ends of said first and second load transfer members are at least partially embedded in said first concrete element in a spaced relationship with one another and said second ends of said first and second load transfer members are at least partially embedded in said second concrete element in a spaced relationship with one another; and wherein said first and second load transfer members transfer all loads independently of each other.

2. The load transfer device of claim 1 wherein said first and second concrete elements are separated by a layer of insulation and wherein said first load transfer member and said second load transfer member are positioned at an angle to the normal of the planes at which said first and second concrete elements meet said layer of insulation.

3. The load transfer device of claim 2 wherein said layer of insulation and said second concrete layer are separated by a space and wherein said first load transfer member and said second load transfer member are positioned at an angle to the normal of the planes at which said first concrete element meets said layer of insulation, said layer of insulation meets said space, and said space meets said second concrete layer.

4. The load transfer device of claim 1 wherein the first and second concrete elements are selected from the group consisting of sandwich wall panel wythes, double wall panel wythes, roof members, floor members, balcony members, canopy members, and sections of pavement.

5. The load transfer device of claim 1 wherein the angles at which said first and second load transfer members are positioned with respect to the normal of the first surface of said first concrete element and the normal of said first surface of said second concrete element are adjustable.

6. The load transfer device of claim 1 wherein at least one of said first load transfer member and said second load transfer member further comprises at least one anchoring means.

7. The load transfer device of claim 1 wherein said angles are between twenty and seventy degrees.

8. The load transfer device of claim 7 wherein said angles are between forty-five and sixty degrees.

9. A sandwich wall panel comprising:

a first concrete layer having a first surface nearest to a second concrete layer;

said second concrete layer having a first surface nearest to said first concrete layer;

an insulation layer located between said first concrete layer and said second concrete layer; and at least one load transfer device connecting said first concrete layer to said second concrete layer and spanning said insulation layer comprising:

a first load transfer member having a first end and a second end;

a second load transfer member having a first end and a second end;

wherein said first load transfer member and said second load transfer member are positioned at an angle to the normal of said first surface of said first concrete layer and at an angle to the normal of said first surface of said second concrete layer;

wherein said first ends of said first and second load transfer members are at least partially embedded in said first concrete layer in a spaced relationship with one another and said second ends of said first and second load transfer members are at least partially embedded in said second concrete layer in a spaced relationship with one another;

wherein said first and second ends of said first and second load transfer members are not in contact with any other load transfer members in said first and second concrete layers; and wherein said first and second load transfer members are positioned in a plane that is perpendicular to shear force acting on said first and second concrete elements and wherein said shear force is coplanar with said first and second concrete layers.

10. The sandwich wall panel of claim 9 wherein said load transfer device further comprises a retention housing to retain said first and second load transfer members at said angle.

11. The sandwich wall panel of claim 10 wherein said load transfer device further comprises a depth locating means for locating said first load transfer member and said second load transfer member at the proper depth in said first and second concrete layers.

12. A double wall panel comprising:

a first concrete layer comprising a first surface nearest to a second concrete layer;

an insulation layer located adjacent to said first concrete layer;

a space located adjacent to said insulation layer and opposite said insulation layer from said first concrete layer;

said second concrete layer located adjacent said space and opposite said space from said insulation layer;

said second concrete layer comprising a first surface nearest to said first concrete layer; and at least one load transfer device comprising:

a first load transfer member having a first end and a second end;

a second load transfer member having a first end and a second end;

wherein said first load transfer member and said second load transfer member are positioned at an angle to the normal of said first surface of said first concrete layer and at an angle to the normal of said first surface of said second concrete layer;

wherein said first ends of said first and second load transfer members are at least partially embedded in said first concrete layer in a spaced relationship with one another and said second ends of said first and second load transfer members are at least partially embedded in said second concrete layer in a spaced relationship with one another;

wherein said first and second ends of said first and second load transfer members are not in contact with any other load transfer members in said first and second concrete layer; and wherein said first and second load transfer members are positioned in a plane that is perpendicular to shear force acting on said first and second concrete elements and wherein said shear force is coplanar with said first and second concrete layers.

13. The double wall panel of claim 12 wherein said load transfer device further comprises a retention housing to retain said first and second load transfer members at said angle.

14. The double wall panel of claim 13 wherein said load transfer device further comprises a depth locating means for locating said first load transfer member and said second load transfer member at the proper depth in said first and second concrete layers.

15. The double wall panel of claim 12 further comprising at least one standoff device.

16. A load transfer device for connecting at least first and second concrete elements comprising:

said first concrete element having a first surface closest to said second concrete element;

said second concrete element having a first surface closest to said first concrete element;

a first linear load transfer member having a first end and a second end;

a second linear load transfer member having a first end and a second end;

wherein said first load transfer member and said second load transfer member are positioned at an angle to the normal of said first surface of said first concrete element and at an angle to the normal of said first surface of said second concrete element;

wherein said first ends of said first and second load transfer members are embedded in said first concrete element in a spaced relationship with one another and said second ends of said first and second load transfer members are embedded in said second concrete element in a spaced relationship with one another; and wherein said first and second load transfer members do not depend on each other to transfer any loads.

17. A load transfer device connecting at least first and second concrete elements comprising:

said first concrete element comprising a first surface nearest to said second concrete element;

said second concrete element comprising a first surface nearest to said first concrete element;

a first load transfer member having a first end and a second end;

a second load transfer member having a first end and a second end;

wherein said first load transfer member and said second load transfer member are positioned at an angle to the normal of said first surface of said first concrete element and at an angle to the normal of said first surface of said second concrete element;

wherein said first ends of said first and second load transfer members are at least partially embedded in said first concrete element in a spaced relationship with one another and said second ends of said first and second load transfer members are at least partially embedded in said second concrete element in a spaced relationship with one another;

wherein said first and second ends of said first and second load transfer members are not in contact with any other load transfer members in said first and second concrete elements; and wherein the loads transferred by the first and second load transfer members are not transferred to the other load transfer member.

18. A load transfer device connecting at least first and second concrete elements comprising:

said first concrete element comprising a first surface nearest to said second concrete element;

said second concrete element comprising a first surface nearest to said first concrete element;

a first load transfer member having a first end and a second end;

a second load transfer member having a first end and a second end;

wherein said first load transfer member and said second load transfer member are positioned at an angle to the normal of said first surface of said first concrete element and at an angle to the normal of said first surface of said second concrete element;

wherein said first ends of said first and second load transfer members are embedded in said first concrete element in a spaced relationship with one another and said second ends of said first and second load transfer members are embedded in said second concrete element in a spaced relationship with one another;

wherein said first and second ends of said first and second load transfer members are not in contact with any other load transfer members in said first and second concrete elements; and wherein said first and second load transfer members are positioned in a plane that is perpendicular to shear force acting on said first and second concrete elements and wherein said shear force is coplanar with said first and second concrete elements.

19. A load transfer device connecting at least first and second concrete elements comprising:

said first concrete element having a first surface closest to said second concrete element;

said second concrete element having a first surface closest to said first concrete element;

a first load transfer member having a first end and a second end, said first load transfer member only in contact with said first and second concrete elements at said first and second ends respectively;

a second load transfer member having a first end and a second end, said second load transfer member only in contact with said first and second concrete elements at said first and second ends respectively;

wherein said first load transfer member and said second load transfer member are positioned at an angle to the normal of said first surface of said first concrete element and at an angle to the normal of said first surface of said second concrete element;

wherein said first ends of said first and second load transfer members are embedded in said first concrete element in a spaced relationship with one another and said second ends of said first and second load transfer members are embedded in said second concrete element in a spaced relationship with one another; and wherein said first and second load transfer members transfer at least one shear load between said first and second concrete elements when said first and second concrete elements are in a service position.

20. The load transfer device of claim 19 wherein said first and second load transfer members transfer additional loads.

21. The load transfer device of claim 20 wherein said additional loads are compression and tension forces.

22. The load transfer device of claim 19 wherein said first and second load transfer members are indirectly connected to one another.

* * * * *